US008419313B2

(12) United States Patent
Lura

(10) Patent No.: US 8,419,313 B2
(45) Date of Patent: Apr. 16, 2013

(54) POWERED ROLLER SCREED WITH RISER WHEEL

(75) Inventor: Dennis K. Lura, Fargo, ND (US)

(73) Assignee: Lura Enterprises, Inc., West Fargo, ND (US)

( * ) Notice: Subject to any disclaimer, the term of this patent is extended or adjusted under 35 U.S.C. 154(b) by 0 days.

(21) Appl. No.: 13/424,621

(22) Filed: Mar. 20, 2012

(65) Prior Publication Data

US 2012/0177441 A1 Jul. 12, 2012

Related U.S. Application Data

(62) Division of application No. 12/357,837, filed on Jan. 22, 2009, now Pat. No. 8,137, 026.

(60) Provisional application No. 61/145,838, filed on Jan. 20, 2009.

(51) Int. Cl.
*E01C 19/23* (2006.01)

(52) U.S. Cl.
USPC ..... 404/118; 404/128

(58) Field of Classification Search ..... 404/85, 404/118, 120, 122, 128, 131, 132
See application file for complete search history.

(56) References Cited

U.S. PATENT DOCUMENTS

| | | | | | |
|---|---|---|---|---|---|
| 910,073 | A | | 1/1909 | Lischke | |
| 985,214 | A | | 2/1911 | Shroyer | |
| 2,025,703 | A | * | 12/1935 | Robert et al. | 404/117 |
| 2,048,071 | A | * | 7/1936 | Jacobson | 404/75 |
| 2,252,188 | A | | 8/1941 | Krehbiel | |
| 2,510,523 | A | | 6/1950 | Schiavi | |
| 3,118,353 | A | | 1/1964 | Neil | |
| 3,229,601 | A | | 1/1966 | Philpott | |
| 3,605,577 | A | * | 9/1971 | Bik | 404/122 |
| 4,142,815 | A | * | 3/1979 | Mitchell | 404/103 |
| 4,702,640 | A | | 10/1987 | Allen | |
| 5,664,908 | A | | 9/1997 | Paladeni | |
| 5,803,656 | A | | 9/1998 | Turck | |
| 6,402,425 | B1 | * | 6/2002 | Paladeni | 404/118 |
| 6,474,906 | B1 | | 11/2002 | Cunningham et al. | |
| 6,503,558 | B2 | | 1/2003 | Williamson | |
| 6,739,799 | B1 | | 5/2004 | Eitzen | |
| 7,544,012 | B2 | | 6/2009 | Lura | |
| 7,704,012 | B2 | | 4/2010 | Lura | |
| 7,959,374 | B2 | * | 6/2011 | Lura | 404/118 |
| 8,137,026 | B2 | * | 3/2012 | Lura | 404/118 |
| 2002/0025224 | A1 | | 2/2002 | Williamson | |
| 2007/0134064 | A1 | | 6/2007 | Lura | |
| 2009/0252554 | A1 | | 10/2009 | Lura | |
| 2010/0189500 | A1 | | 7/2010 | Lura | |
| 2011/0188930 | A1 | * | 8/2011 | Lura | 404/118 |
| 2012/0045282 | A1 | * | 2/2012 | Lura | 404/118 |

* cited by examiner

*Primary Examiner* — Gary S Hartmann
(74) *Attorney, Agent, or Firm* — Marsh Fischmann & Breyfogle LLP; James L. Johnson

(57) ABSTRACT

A rotating cylinder cement screeding system having a drive assembly and handle at one end for powering and controlling the screeding system. The rotating cylinder may be defined by one or more tubular screed roller sections of varying lengths, thereby allowing a user to customize the length of the system to match a specific cement pour. Further, each tubular screed roller section may be supplied with a male and female end for interlocking with each other and for receiving a variety of add-on attachments. At least one riser assembly may be interconnected to a drive assembly end and/or a non-driven end of the rotating cylinder cement screeding system. The riser assembly may elevate the rotating cylinder a distance above a finished slab to prevent the rotating cylinder from contacting the finished slab during a screeding operation.

15 Claims, 15 Drawing Sheets

POWERED ROLLER SCREED WITH RISER WHEEL

CROSS-REFERENCE TO RELATED APPLICATIONS

This patent application is a divisional of, and claims priority to, U.S. patent application Ser. No. 12/357,837 (now U.S. Pat. No. 8,137,026), that is entitled "POWERED ROLLER SCREED WITH RISER WHEEL," and that was filed on Jan. 22, 2009, which is a non-provisional application of U.S. Provisional Patent Application Ser. No. 61/145,838, that is entitled "POWERED ROLLER SCREED WITH RISER WHEEL," that was filed on Jan. 20, 2009. The entire disclosure of both of these patent applications is hereby incorporated by reference in their entirety herein.

FIELD OF THE INVENTION

The present invention generally relates to the leveling of materials such as wet or recently poured concrete and, more particularly, to attachments for a powered roller screed.

BACKGROUND

Concrete may be poured between a pair of forms, between a pair of existing, hardened concrete slabs, between a form and an existing, hardened concrete slab, or the like. Once the concrete is poured, it may be leveled and compacted by a process known as "screeding." Various types of screeding devices have been used over time.

A basic screeding device may be a simple 2×4 or some other elongate member. One or more workers would place the 2×4 on the forms and pull/slide the 2×4 along the forms to screed the poured concrete. While this manual technique may work to at least some degree for at least smaller jobs (e.g., short sections of sidewalk), there are a number of deficiencies. One of course is that this technique is very labor intensive and physically demanding. This type of screeding is also not very effective at distributing and compacting the concrete within the forms, thereby potentially producing a finished concrete slab of a lesser quality than may be desired.

Truss screeds also exist, and tend to be used for larger jobs. The concrete is leveled off with an elongated truss. One or more internal combustion engines or the like may be mounted on the truss to vibrate the truss to enhance the screeding. Typically one or more winches are incorporated into the truss to advance the same along the forms. Both manual and motorized winches exist for truss screeds.

Another type of powered screed is a powered roller screed. The powered roller screed generally consists of a screed roller (e.g., an elongated tube) that is rotationally driven by an attached motor. In operation, the screed roller is positioned over the poured concrete with each end of the screed roller positioned on the upper edges of the laterally-spaced forms. The screed roller is then moved along the top of the forms in a direction that is opposite to the rotational motion of the screed roller at its point of contact with the concrete. Usually one worker pulls on one end of the powered roller screed, and another worker pulls on the opposite end of the powered roller screed. Powered roller screeds produce a smooth and flat finish to the concrete.

SUMMARY OF THE INVENTION

A first aspect of the present invention is embodied by a powered roller screed having a screed roller and a drive assembly that interacts with the screed roller to rotationally drive the screed roller. At least two handles may be interconnected with the screed roller to allow at least two workers to exert a pulling force on the screed roller as it is being rotated by the drive assembly. In any case, a first riser wheel is appropriately interconnected with the screed roller. The outer diameter of the first riser wheel is larger than the outer diameter of the screed roller. Moreover, the first riser wheel and screed roller are rotationally independent from each other.

A number of feature refinements and additional features are applicable to the first aspect of the present invention. These feature refinements and additional features may be used individually or in any combination. As such, each of the following features that will be discussed may be, but are not required to be, used with any other feature or combination of features of the first aspect. The following discussion is applicable to the first aspect, up to the start of the discussion of a second aspect of the present invention.

Each handle for the powered roller screed may be of any appropriate size, shape, configuration, and/or type (e.g., a rigid member, a flexible member, a rope, a strap, a tether, a chain). Any appropriate way of interconnecting each handle with the screed roller may be utilized that allows the screed roller to rotate relative to each such handle (e.g., each handle may be rotationally isolated from the screed roller). First and second handles may be spaced along the length of the screed roller. One handle may be associated with the drive assembly (e.g., extending from a frame that supports a motor of the drive assembly). In one embodiment, one handle is associated with one end portion of the screed roller, and another handle is associated with an opposite end portion of the screed roller.

Any appropriate power source may be utilized by the drive assembly. For instance, the drive assembly may utilize one more motors of any appropriate type. Representative motors that may be used to rotate the screed roller include without limitation an electric motor, an internal combustion engine, and the like. In one embodiment, the screed roller is rotated at a relatively high velocity (e.g., at least 100 RPM, and commonly 300 RPM) and in a direction that attempts to advance the screed roller in the opposite direction that the same is pulled during a screeding operation.

The screed roller may be of any appropriate size (e.g., length), shape (e.g., cylindrical), and/or configuration. The screed roller may utilize a single cylindrical structure or tube. In one embodiment, however, the screed roller is defined by detachably interconnecting two or more separate screed roller sections in end-to-end relation (e.g., via a threaded connection between each adjacent pair of screed roller sections). Any appropriate number of detachably interconnected screed roller sections may be utilized to define a screed roller of a desired/required length. "Detachably interconnected" means that individual screed roller sections may be repeatedly joined and separated, or vice versa, as desired/required (e.g., joined for a screeding operation at a job site; separated or disassembled for transport and/or storage).

A rotational axis of the first riser wheel may be coaxial with a rotational axis of the screed roller. There may be a first bearing between the first riser wheel and the screed roller (e.g., such that the first riser wheel is able to rotate relative to the screed roller). The first riser wheel may be a free-spinning structure, while the screed roller is rotatably driven. In one embodiment, the first riser wheel and the screed roller rotate in opposite directions during screeding.

The first riser wheel may be positioned between a first end of the screed roller and the drive assembly. A coupling (e.g., drive socket) that interconnects the drive assembly and the screed roller (e.g., to transport rotational power to the screed roller) may extend through the first riser wheel (e.g., where the first riser wheel may rotate relative to this coupling). The first riser wheel may also be interconnected with what may be referred to as a non-driven or non-powered end, or the end of the screed roller that is opposite the end where the power is input to the screed roller. In one embodiment, the rotational axes of the first riser wheel and screed roller are coaxial and the first riser wheel is disposed beyond an end of the screed roller.

The first riser wheel may have an outer diameter that is larger than the outer diameter of the screed roller by any appropriate amount, such as ¼" or ¾" (to provide a ⅛" or ⅜" gap, respectively, between the screed roller and the surface on which the first riser wheel is disposed). In one embodiment, the outer diameter of the first riser wheel is defined by an outer bearing race. In another embodiment, the outer diameter of the first riser wheel is defined by an outer ring that is appropriately mounted on the outer bearing race. In any case, the first riser wheel may be disposed on a concrete slab that is hardened to at least a degree so as to dispose and maintain the screed roller in spaced relation to this concrete slab when screeding poured concrete adjacent to the concrete slab (e.g., the concrete slab being used as a form).

A single riser wheel may be utilized by the powered roller screed (e.g., to dispose the screed roller at an incline relative to horizontal during a screeding operation, for any appropriate purpose). Multiple riser wheels may be utilized by the powered roller screed as well. Two riser wheels could be interconnected with the screed roller, where these riser wheels are of a common outer diameter (e.g., to dispose the screed roller, more specifically its rotational axis, in at least substantially horizontal relation), or of different outer diameters. The various features discussed above with regard to the first riser wheel are equally applicable to such a second riser wheel, individually or in any combination.

In one embodiment, one riser wheel is disposed beyond one end of the screed roller and another riser wheel is disposed beyond the opposite end of the screed roller. In any case, the first riser wheel may be disposed on a first concrete slab that is sufficiently hardened, a second riser wheel may be disposed on a second concrete slab that is sufficiently hardened and spaced from the first concrete slab, all so as to dispose and maintain the screed roller in spaced relation to each of the first and second concrete slabs when screeding concrete that has been poured between the two concrete slabs (e.g., each concrete slab being used as a form). Each such riser wheel may rotate at a speed that is dependent upon the linear speed that the screed roller is being pulled (e.g., the linear speed that the rotational axis of the screed roller is being moved by the operator(s) of the powered roller screed and relative to an upper surface of the first and second concrete slabs).

A second aspect of the present invention is embodied by a cement screed system. The cement screed system may generally include a screed roller and a drive assembly. The screed roller may have a first end and a second end. The drive assembly may be interconnected to the screed roller and operable to rotate the screed roller. The cement screed system may also include at least one riser assembly that is at least partially rotatable relative to the screed roller and drive assembly. The riser assembly may be operable to elevate the portion of the screed roller that makes contact with freshly poured concrete a distance above a finished concrete slab. Among other advantages, elevating the screed roller a distance above a finished concrete slab can prevent marring or scratching of the finished concrete slab by the rotating screed roller, facilitate the pulling of the cement screed system over the finished and freshly poured concrete surfaces, and allow operators to level the freshly poured concrete surfaces at elevations above the finished slabs and/or create inclined surfaces relative to the finished slabs.

In an embodiment, the screed roller of the cement screed system may comprise a plurality of individual, removable screed roller sections that are interconnected in any appropriate manner. For instance, the screed roller sections may be attached to each other through threaded connections at the ends of the individual screed roller sections (e.g., each screed roller section may have a threaded male member on one end and a threaded female member on its opposite end), although multiple screed roller sections may be detachably interconnected in any appropriate manner. Each of any screed roller sections may be of any appropriate length. Two or more of multiple screed roller sections that define the screed roller may be of different lengths, although such may not be the case in all instances. The overall length of the screed roller may be varied by removing and/or adding at least one screed roller section. Notwithstanding the foregoing, the screed roller could be in the form of a single screed roller section (e.g., the screed roller need not be defined by multiple screed roller sections).

In an embodiment, the drive assembly may be interconnected with the screed roller at least generally adjacent to the first end and in any appropriate manner. The drive assembly may be of any appropriate size, shape, configuration, and/or type (e.g., an electric motor, a gasoline engine). In one embodiment, the drive assembly is detachably interconnected with the screed roller. In one embodiment, the drive assembly includes a handle or the like to allow an operator to grasp the same and exert a pulling force on the screed roller.

In an embodiment, the cement screed system may include a bracket interconnected to the screed roller at least generally adjacent to the second end of the screed roller (e.g., disposed at or closely spaced from the second end). The bracket may be interconnected to the screed roller via a bearing such that the screed roller is free to rotate relative to the bracket. The cement screed system may include a handle assembly of any appropriate configuration for controlling the second end of the screed roller. The handle assembly may include a frame (e.g., one or more substantially rigid members that may be appropriately interconnected) and a first handle. The frame may be appropriately interconnected to the bracket (e.g., detachably). The handle assembly may also be in the form of a rope, strap, or the like. The handle assembly may allow an operator gripping the handle assembly to move the second end of the screed roller in at least one direction (e.g., to pull on the screed roller to move the same in a direction that is opposite to the direction that the screed roller is being biased by its rotation). The handle assembly may allow the operator standing in front of the path of the screed roller to move the second end of the screed roller in a backward or forward direction, as well as up or down. The handle assembly may further include a second handle interconnected to the frame. The first and second handles may be positioned such that an operator controlling the second end of the screed roller may grasp one such handle in each hand.

The various features addressed in relation to the first aspect may be used by the second aspect, or vice versa, and individually or in any combination. Any feature of any of the various aspects of the present invention that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular (e.g., indicating that a powered roller screed includes "a riser wheel" alone does not mean that the powered roller screed includes only a single riser wheel). Moreover, any failure to use phrases such as "at least one" also does not limit the corresponding feature to the singular (e.g., indicating that a powered roller screed includes "a riser wheel" alone does not mean that the powered roller screed includes only a single riser wheel). Finally, use of the phrase "at least generally" or the like in relation to a particular feature encompasses the corresponding characteristic and insubstantial variations thereof (e.g., indicating that a screed roller is at least generally cylindrical encompasses the screed roller actually being cylindrical).

DETAILED DESCRIPTION

Figure 1:
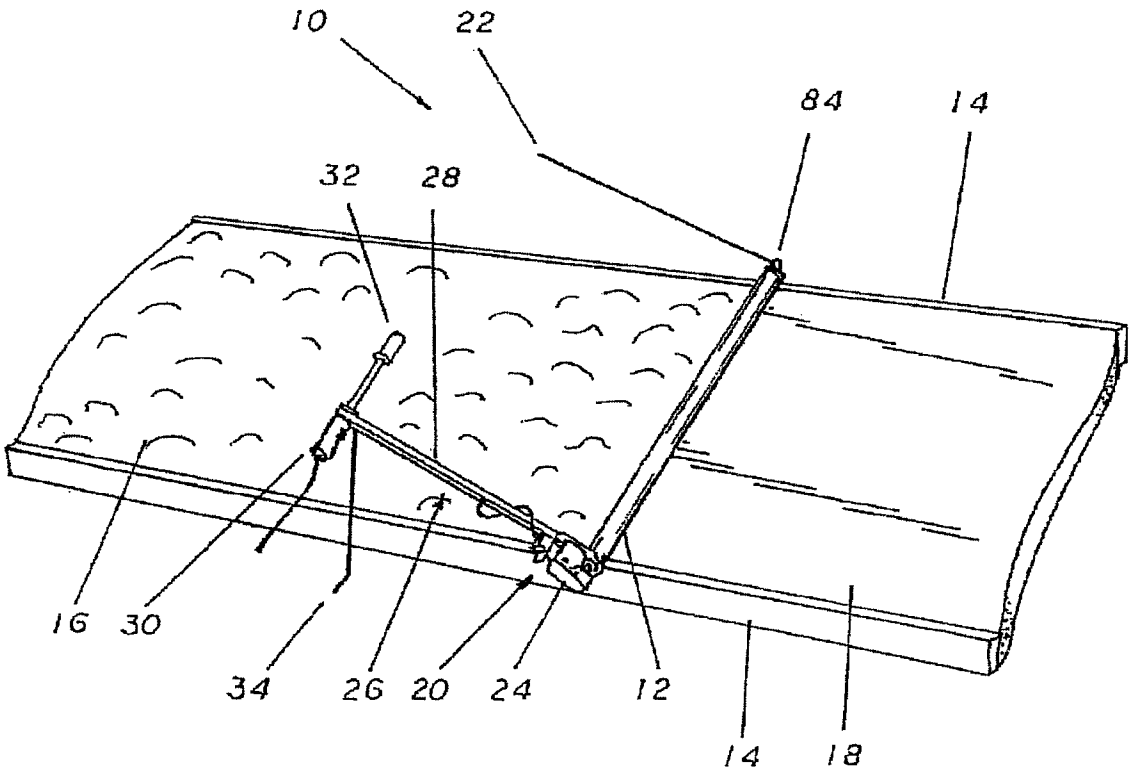
FIG. 1 is a perspective view of an embodiment of a powered roller screed that illustrates the manner in which it may be deployed to finish a slab of concrete.
Figure 2:
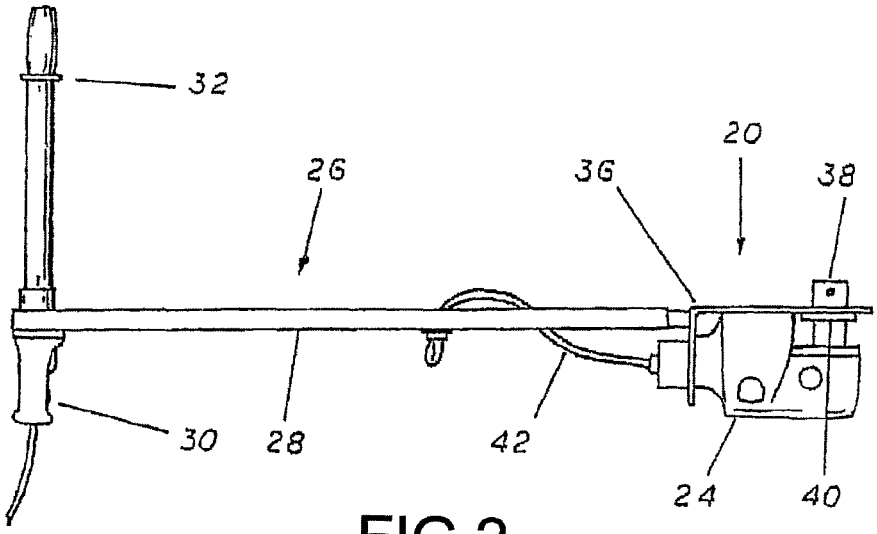
FIG. 2 is a top elevation view of a drive assembly for the powered roller screed of FIG. 1.
Figure 3:
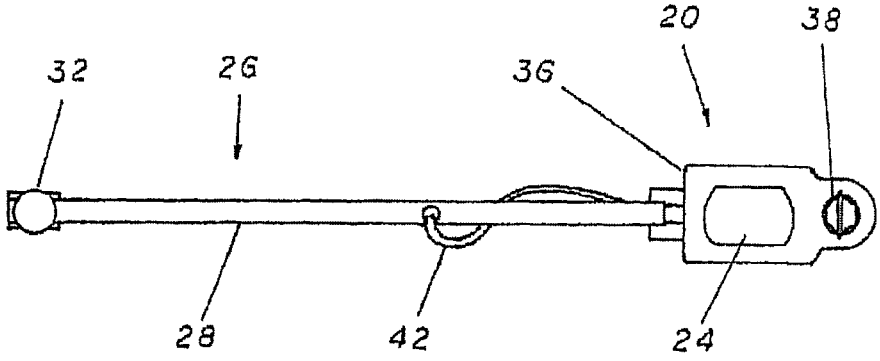
FIG. 3 is an end elevation view of the drive assembly of FIG. 2.

Referring to the drawings, and more specifically initially to FIGS. 1-3, a powered rotational screed apparatus or powered roller screed 10 has a screed roller 12 that is adaptable to accommodate any number of specialized concrete slab pouring applications. The powered rotational screed apparatus 10 is designed generally to facilitate the finishing process in relation to the formation of concrete slabs. In the accomplishment of this process, the powered rotational screed apparatus 10 may be deployed on a slab pour site in a manner so that its screed roller 12 comes into contact with both the upper surfaces of the concrete forms 14 and the unfinished concrete 16 contained therein. This is accomplished by placing the screed roller 12 between the concrete forms 14 and over the area where the slab is to be formed.

One end or end portion of the screed roller 12 is rotationally attached to a drive assembly 20 and the other end or end portion to a pull device 22 (e.g., a handle) of any appropriate type (e.g., a strap, rope, or the like). The drive assembly 20 is the component of the powered rotational screed apparatus 10 that houses a drive motor 24, which in turn provides the rotational power to operate the powered rotational screed apparatus 10 (more specifically to rotate the screed roller 12). The drive motor 24 is fixed within the drive assembly 20 by the use of a motor frame 36, that also provides the point of fixed attachment for a handle assembly 26. The handle assembly 26 extends upward through an extension bar 28 from the motor frame 36 to position a control grip or handle 30 and a pull grip or handle 32 in a position so that the entire handle assembly 26 can be easily controlled by an operator. Finally, the power to the drive motor 24 is supplied through a power cord 42 by way of the control handle 30. The drive motor 24 may also be powered by an appropriate "on board" battery, an internal combustion engine (not shown), or any other appropriate power source.

The other end, or the non-powered or non-driven end, of the screed roller 12 (e.g., the end of the screed roller 12 that is opposite of the end where rotational power is input to the screed roller 12) provides the point of attachment for the pull device 22 through the operation of a pull bearing assembly 84. The pull bearing assembly 84 operates to isolate the pull device 22 from the rotational aspects of the screed roller 12, allowing it to be interconnected to the pull device 22 while allowing the screed roller 12 to rotate relative to the pull device 22. The nature and manner of operation of the pull bearing assembly 84 will be described in greater detail below with reference to other possible components of the powered rotational screed apparatus 10.

Additionally, the handle assembly 26 of the powered rotational screed apparatus 10 may be equipped with a pivotally mounted stand 34. The stand 34 allows the drive assembly 20 to be left in an upright position when not in use so that the control and pull handles, 30 and 32, respectively, are in an easily accessible location. When not in use, the pivotal attachment of the stand 34 allows it to be pivoted or rotated up next to the extension bar 28 so that it is not in the way during the operation of the handle assembly 26.

To perform the finishing or screeding operation, the drive motor 24 is engaged by the use of the control handle 30, which in turn powers the screed roller 12. As the screed roller 12 spins, the operator of the drive assembly 20 and the operator of the pull device 22 move the powered rotational screed apparatus 10 in a direction that is opposite to the rotation of the screed roller 12 over the unfinished concrete 16. This action has been found to be effective in producing the desired finish on the upper surface of the finished or screeded concrete 18, while also causing the concrete to compact to a desired consistency.

Figure 4:
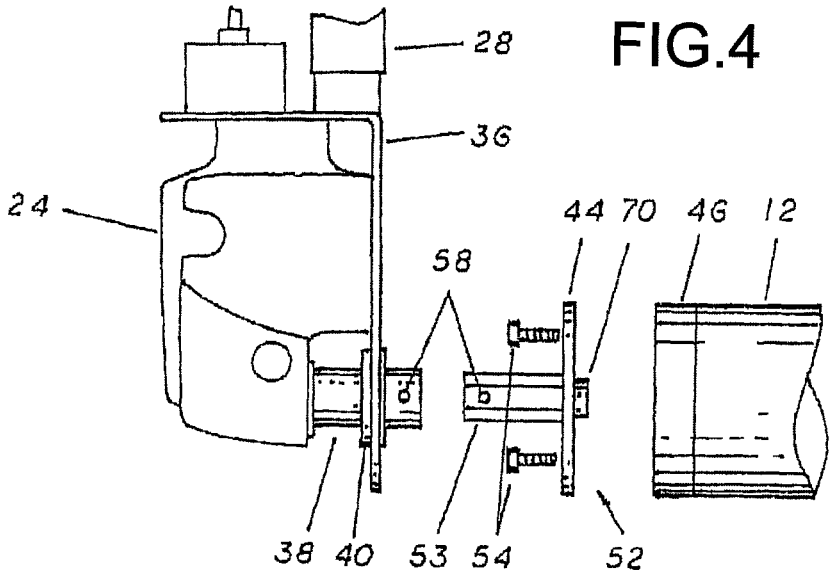
FIG. 4 is a front elevation exploded view of drive motor and drive plate assembly components of the drive assembly of FIG. 2, illustrating the manner by which they may engage the screed roller.

The output of the drive motor 24 is configured so that it can be fitted to a drive socket 38, which may be of a common 6-point impact type as illustrated in FIG. 4. As the drive socket 38 passes through the motor frame 36, the drive socket 38 is encased by a socket bearing 40. The socket bearing 40 allows the drive socket 38 to spin with the drive motor 24, while securely holding it within the stationary motor frame 36.

The use of the drive socket 38 allows for the securement of a drive plate assembly 52, which in turn bolts to the proximal end of the screed roller 12. To facilitate this, the drive plate assembly 52 is equipped with a rearwardly extending hexagonal shaft 53 that is specifically designed to engage the internal surface of the drive socket 38. Additionally, each of these components has an attachment pin hole 58. The attachment pin holes 58 allow for the passage of an attachment pin or the like (not shown) through the drive socket 38 and hexagonal shaft 53 to secure the two together (such that they collectively rotate).

The drive plate assembly 52 also has a circular drive plate 44 that may be of the same outside diameter as the screed roller 12. The drive plate 44 allows for the attachment of the drive plate assembly 52 to the screed roller 12 through the use of a plurality of bolts 54 or other suitable fasteners. Additionally, the distal surface of the drive plate 44 is equipped with a centrally located male shoulder 70 that operates to center a female attachment plug 46 of the screed roller 12 with reference to the drive plate assembly 52. This configuration not only transfers the rotational power of the drive motor 24 to the screed roller 12, but also ensures that all of the operational components are properly aligned.

Figure 5:
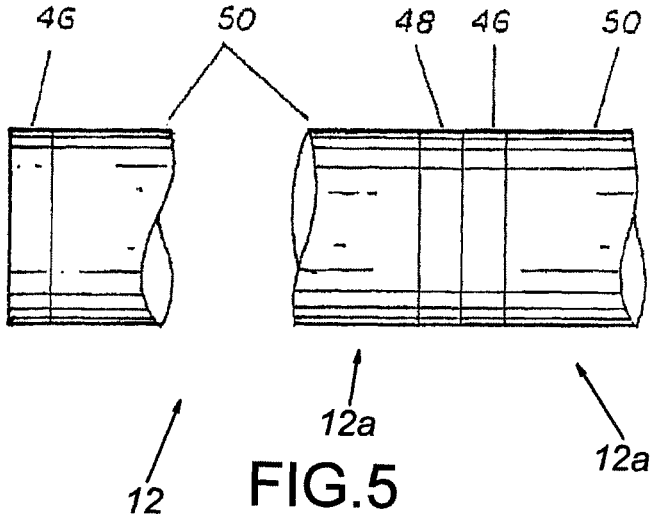
FIG. 5 is a front elevation view of a screed roller for the powered roller screed of FIG. 1, illustrating its general manner of construction and a way two or more individual screed roller sections can be joined together to form a longer screed roller.
Figure 6:
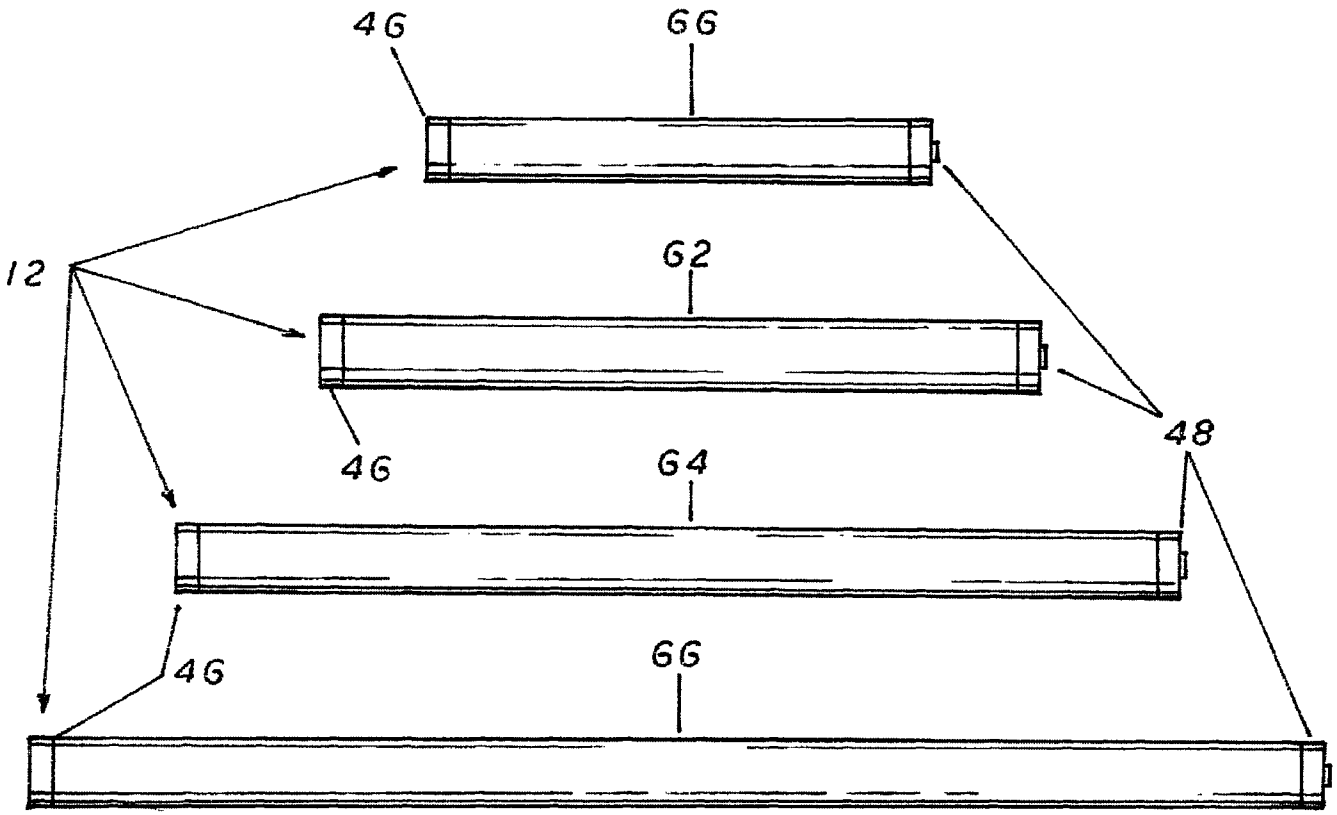
FIG. 6 is a front elevation view of a plurality of screed rollers, illustrating the varying lengths in which they can be constructed.

The screed roller 12 is the elongated cylindrical component of the powered rotational screed apparatus 10 that performs the finishing or screeding operation, and may be defined by connecting one or more screed roller sections 12*a* in end-to-end relation. The external manner of construction of the screed roller 12 is illustrated in FIGS. 5 and 6. Each screed roller section 12*a* is made up of three primary components. The first of these is a tube body 50, which is a tube of the desired inside and outside diameter and may be generally composed of a high strength aluminum alloy, although the use of other materials for this purpose is possible. Aluminum may be used in this application due to its desirable strength-to-weight ratio. The other components of an individual screed roller section 102*a* are a female and male attachment plug, 46 and 48, respectively, disposed on the opposite ends of the tube body 50.

The female and male attachment plugs, 46 and 48, are relatively short cylindrical components having a shoulder of a common outside diameter of the tube body 50 and an engagement body that has an outside diameter that is equal to the inside diameter of the tube body 50. Each screed roller section 12*a* is formed by fixedly attaching one female attachment plug 46 and one male attachment plug 48 to the opposite ends of the tube body 50. This forms a complete unit that is then capable of being used individually or in conjunction with another screed roller section 12*a* as will be described in greater detail below.

The above-described method of constructing a screed roller section 12*a* provides a means by which the powered rotational screed apparatus 10 can be adapted to match the width of a wide variety of possible concrete pours. This is facilitated by the building of screed rollers 12 of varying lengths by joining together two or more individual screed roller sections 12*a* (again, another option is to use a single screed roller section 12*a* for the screed roller 12). This design allows for the construction of screed rollers 12 of varying lengths as illustrated by screed rollers, 60, 62, 64, and 66. Additionally, it must be stated that the lengths of the screed rollers as shown is intended to be for illustrative purposes only, and the construction of a screed roller of any usable length is possible.

Figure 7:
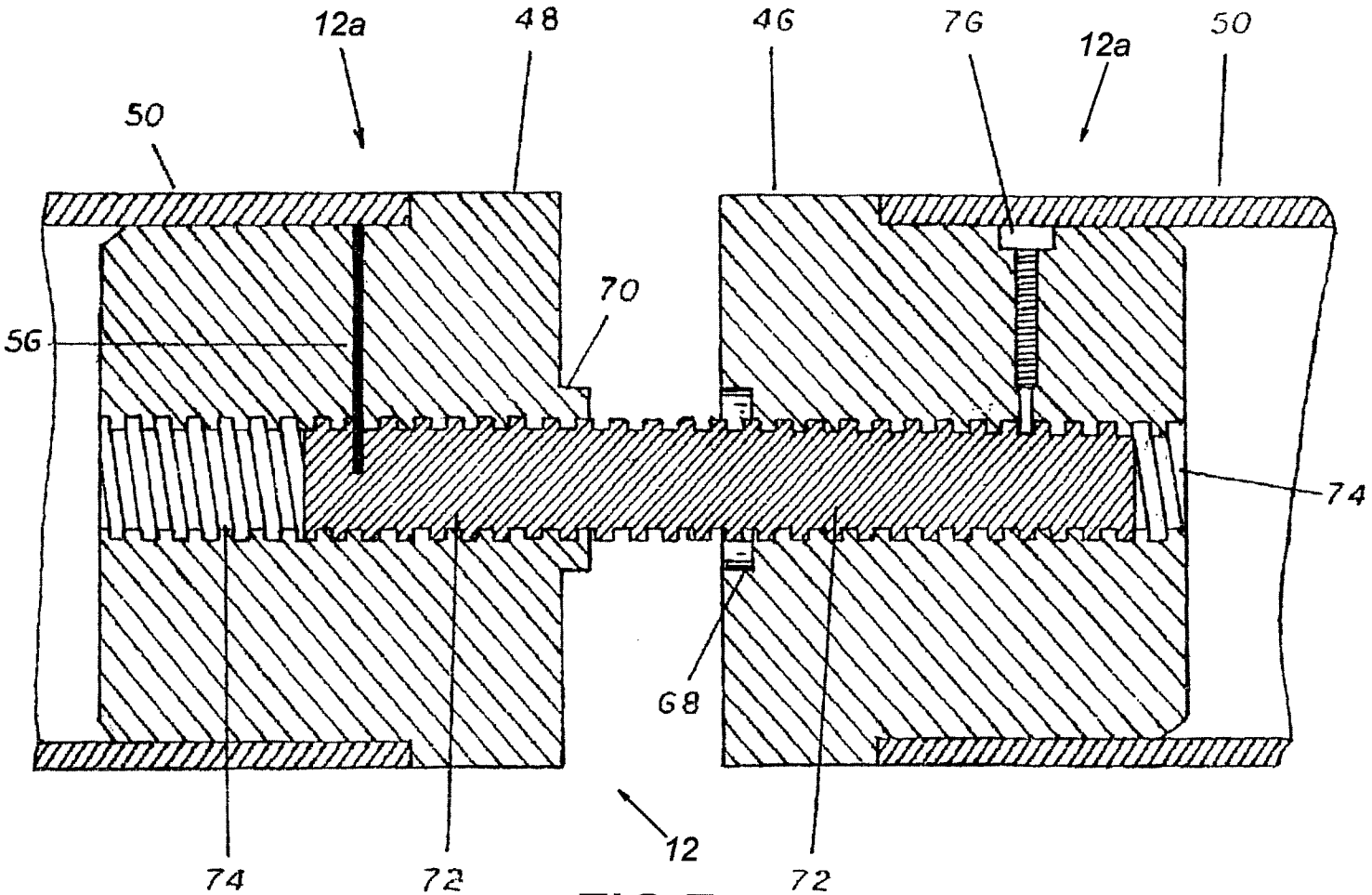
FIG. 7 is a cross-sectional view of a connection between two adjoining individual screed roller sections.

The female and male attachment plugs, 46 and 48, also contain a threaded hole 74 that passes longitudinally through their respective centers as illustrated in FIG. 7. The threaded hole allows 74 for the placement of a threaded rod 72 in a position so that it extends out beyond the outside end of the male attachment plug 48 to which it is fixedly attached. This attachment is accomplished by passing an attachment pin 56 through the body of the male attachment plug 48 in a manner so that it engages the threaded rod 72. In this configuration, the attachment pin 56 is retained within the male attachment plug 48, even when the screed roller 12 is disassembled.

The female attachment plug 46 is designed with a centrally located, with respect to its longitudinal axis, female recess 68 that extends into its body at the initial segment of its threaded hole 74. Conversely, the male attachment plug 48 is designed with a similarly positioned male shoulder 70 that fits within the female recess 68 of the female attachment plug 46 of an adjacent screed roller section 12*a*. Thus, the threaded rod 72, the female recess 68, and the male shoulder 70 components of the female and male attachment plugs, 46 and 48, provide a means by which two or more screed roller sections 12*a* can easily and securely be connected to one another to define a screed roller 12. Finally, once the proper connection has been accomplished through the described methods, the female attachment plug 46 can be locked in place with reference to the threaded rod 72. This may be accomplished by the use of a securement bolt 76 that passes through the body of the female attachment plug 46 to engage the surface of the threaded rod 72. The head of the securement bolt 76 may be accessible on an exterior of the screed roller 12.

The connection of two or more screed roller sections 12*a* is then simply accomplished by connecting the desired screed roller sections 12*a* by the use of the threaded rod 72 and threaded hole 74 and their associated components. Also, this design provides a means of attaching additional components that will be discussed in greater detail below.

Figure 8:
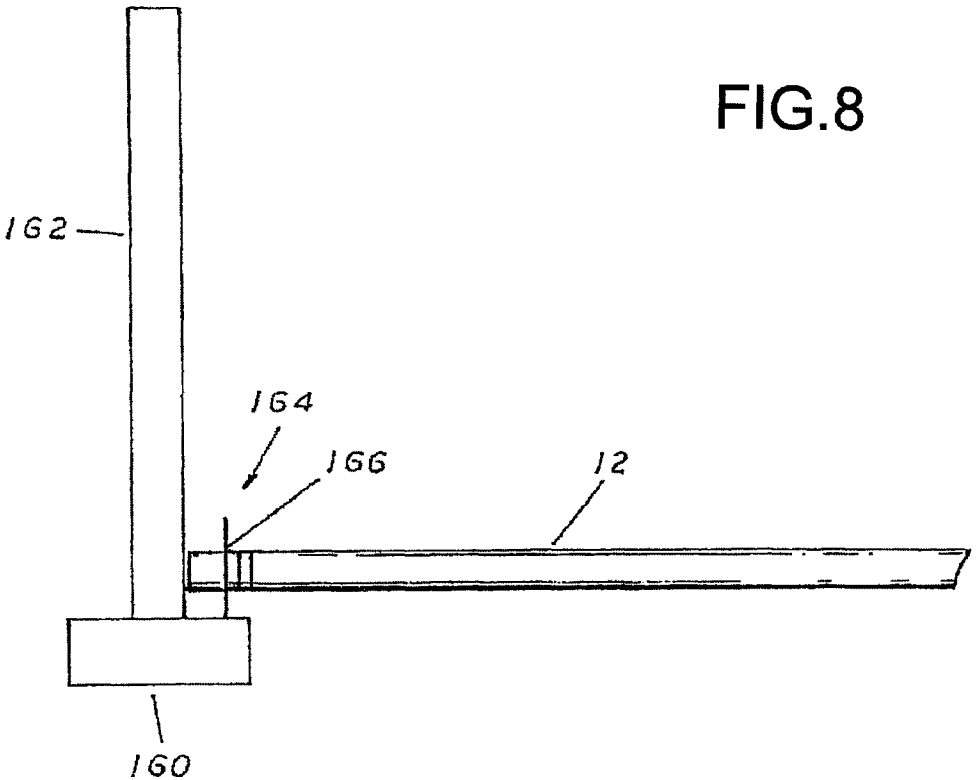
FIG. 8 is a front elevation view of a footing member component that may be used by the powered roller screed of FIG. 1.
Figure 9:
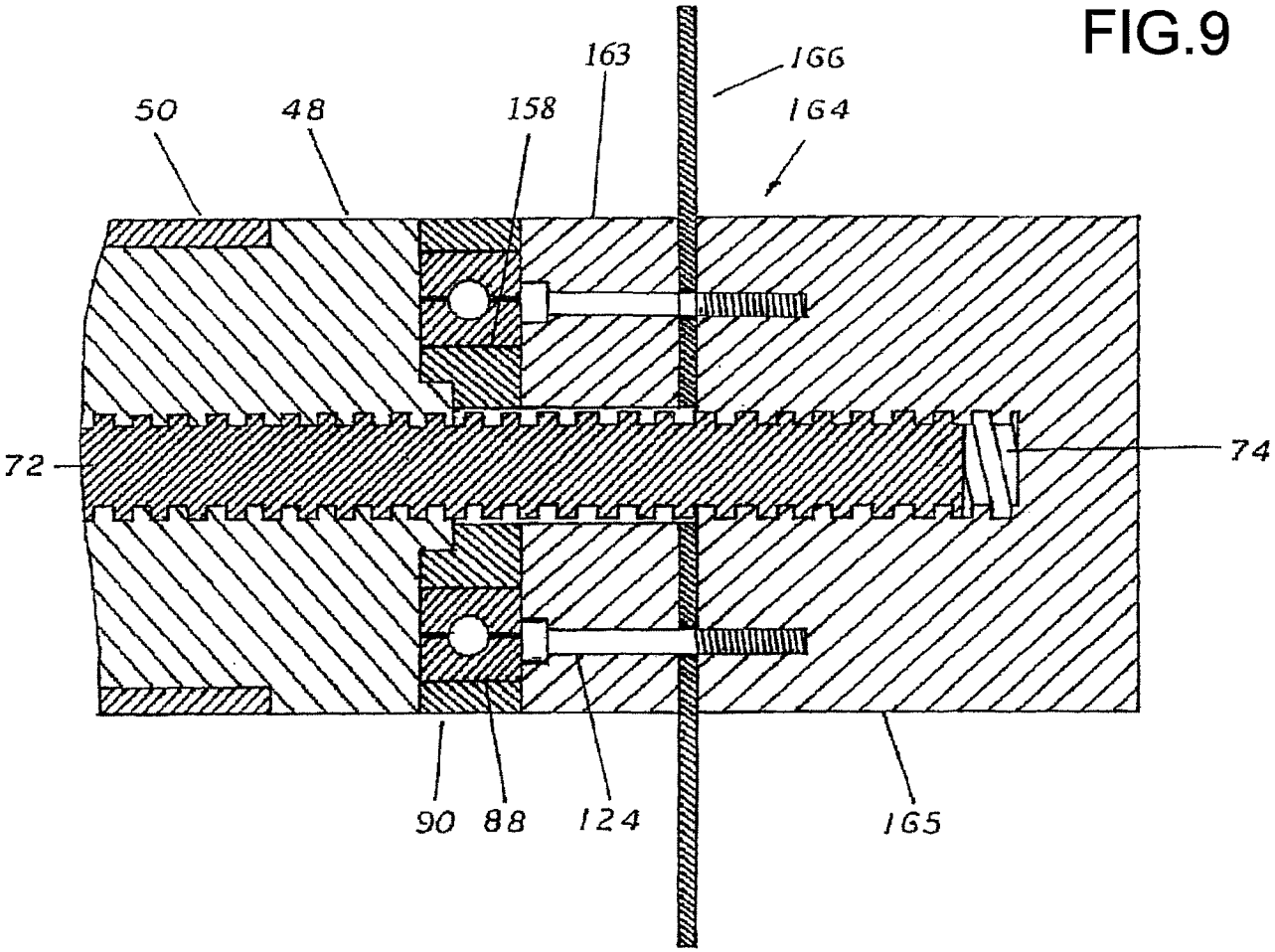
FIG. 9 is a cross-sectional view of the footing member component from FIG. 8.

An attachment for the powered rotational screed apparatus 10 is illustrated in FIGS. 8 and 9, and is in the form of a wall plug or footing member 164. The footing member 164 provides the powered rotational screed apparatus 10 with the capability of finishing a concrete slab that is used to form the floor of a basement where the footings 160 and walls 162 are already built. The footing member 164 is made up of a footing member body 165 that is attached to the non-powered end of the screed roller 12 using an outer bearing body 90, a bearing 88, and an inner bearing spacer 158.

The footing member 164 is equipped with a ring spacer 166. The ring spacer 166 is a circular plate that is inserted between the footing member body 165 and the footing member spacer 163 in a location so that it effectively raises the screed roller 12 up off of the footing 160. Additionally, the footing member spacer 163, the ring spacer 166, and the footing member body 165 are held together by the use of a plurality of large bolts 124. This design allows for the simplified pouring of such a concrete slab up to the wall and over the footing to properly construct a basement floor.

Figure 10:
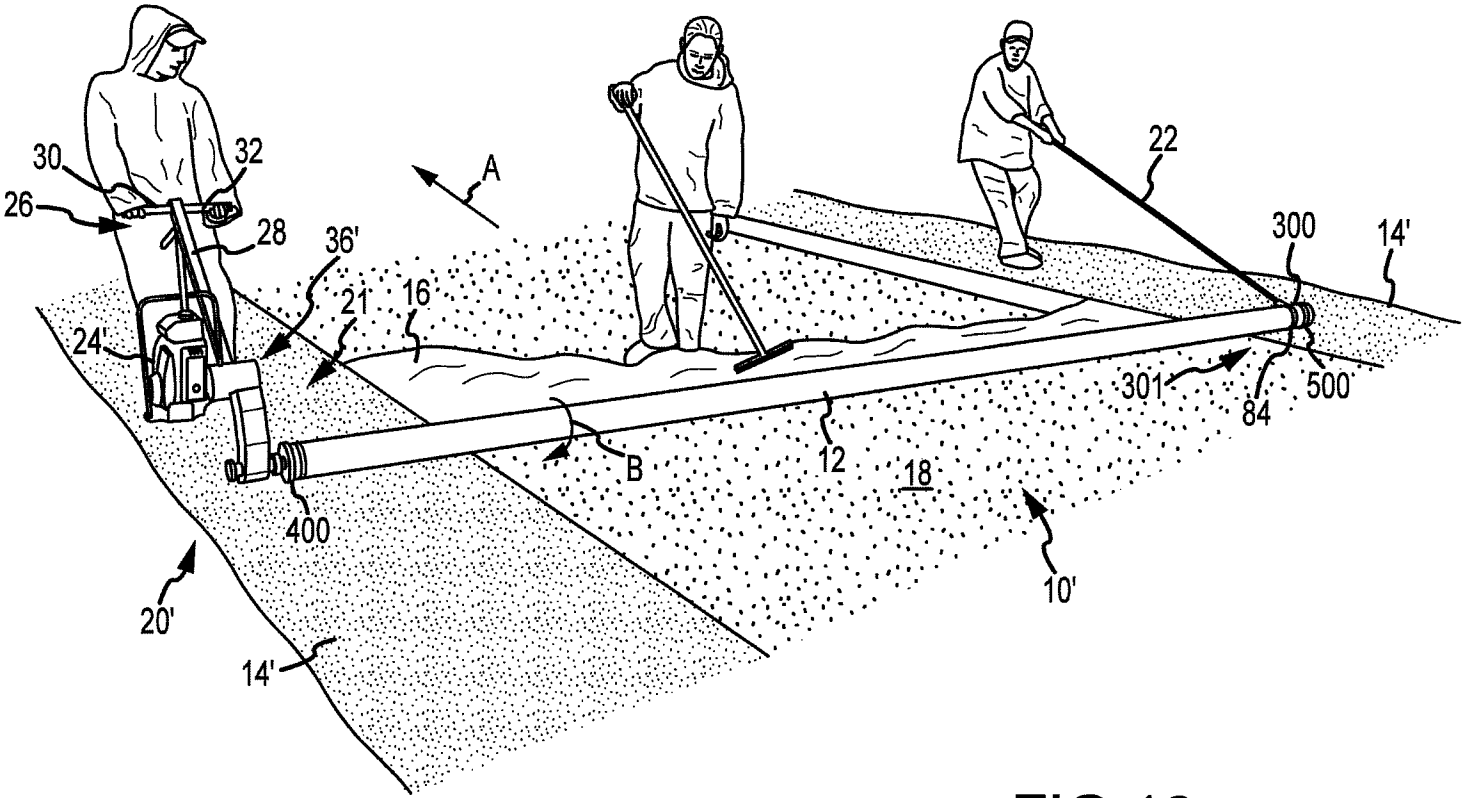
FIG. 10 is a perspective view of an embodiment of a powered roller screed that illustrates the manner in which it may be deployed to screed concrete that has been poured between a pair of concrete slabs.

Another embodiment of a powered rotational screed apparatus or powered roller screed is illustrated in FIG. 10 and is identified by reference numeral 10'. Corresponding components between the embodiments of FIG. 1 and FIG. 10 are identified by the same reference numeral. Those corresponding components between these two embodiments that differ in at least some respect and that are addressed herein are identified by a "single prime" designation in FIG. 10. Notwithstanding the existence of at least some differences between the embodiments, both powered roller screeds 10, 10' screed in the same general manner—the screed roller 12 spins or rotates at a relatively high velocity (e.g., about 300 RPM), and is pulled by personnel in the opposite direction that the screed roller 12 is rotating. That is and for screeding operations, the screed roller 12 is pulled by personnel in the direction indicated by the arrow A as the screed roller 12 is rotating in the direction indicated by the arrow B. The direction that the screed roller 12 is rotating (arrow B) attempts to move the screed roller 12 in a direction that is opposite to the direction that the screed roller 12 is being pulled by personnel during screeding (arrow A).

Unless otherwise noted, all of the various features addressed above in relation to the powered roller screed 10 of FIG. 1 may be utilized by the powered roller screed 10' of FIG. 10. The powered roller screed 10' of FIG. 10 is illustrated as utilizing a drive motor 24' (of the drive assembly 20') that is in the form of an internal combustion engine, although any appropriate rotational power source may be utilized by the powered roller screed 10' and including the electric motor illustrated in relation to the powered roller screed 10 of FIG. 1. The control handle 30 of the handle assembly 26 (used by an operator to pull on one end portion of the powered roller screed 10') may also function as a hand-operated throttle for the drive motor 24' to control the rotational speed of the screed roller 12, while the other handle 32 of the handle assembly 26 may simply provide an appropriate gripping location for the operator's other hand. That is, and in also accordance with the powered roller screed 10 of FIG. 1, one operator may exert a pulling force on the screed roller 12 via the handle assembly 26 of the powered roller screed 10' of FIG. 10, while another operator may exert a pulling force on the screed roller 12 via a pull device 22 (e.g., a rope, strap, chain, tether, tube-like structure or any other appropriate handle type/configuration).

The powered roller screed 10' of FIG. 10 is illustrated in a different type of concrete pour compared to the powered roller screed 10 of FIG. 1, and as such the powered roller screed 10' of FIG. 10 utilizes a different configuration (e.g., via incorporating two additional attachments). Instead of using a pair of forms 14 to screed as in FIG. 1, the powered roller screed 10' in FIG. 10 is being used to screed wet concrete 16 that has been poured between a pair of existing concrete slabs 14' that have at least partially cured. That is, the concrete slabs 14' have been allowed to cure at least to the degree where the concrete slabs 14' will support personnel without adversely impacting the concrete slabs 14' in any significant manner. In this regard, the powered roller screed 10' includes a riser assembly 400 on a drive assembly end 21 of the screed roller 12, along with a riser assembly 500 on a non-powered end 301 of the screed roller 12 member. Certain applications may require the use of only one of the riser assemblies 400, 500.

Generally, the riser assemblies 400, 500 support the screed roller 12 on the pair of concrete slabs 14', and furthermore maintain the spinning screed roller 12 in spaced relation to each of these concrete slabs 14'. That is, the screed roller 12 is allowed to spin or rotate relative to each of the riser assemblies 400, 500. As such, the spinning screed roller 12 should not contact and mar the upper surface of either concrete slab 14'. Correspondingly, the lack of contact between the concrete slabs 14' and the screed roller 12 should reduce wear and tear on the screed roller 12 as well for the illustrated screeding operation. Although the powered roller screed 10' of FIG. 10 is illustrated as using the same type of screed roller 12 used by the powered roller screed 10 of FIG. 1, the screed roller 12 used by the powered roller screed 10' could be defined by a single screed roller section 12*a* of a fixed length (instead of a plurality of individual screed roller sections 12*a* joined in end-to-end relation, as described above).

Figure 11:
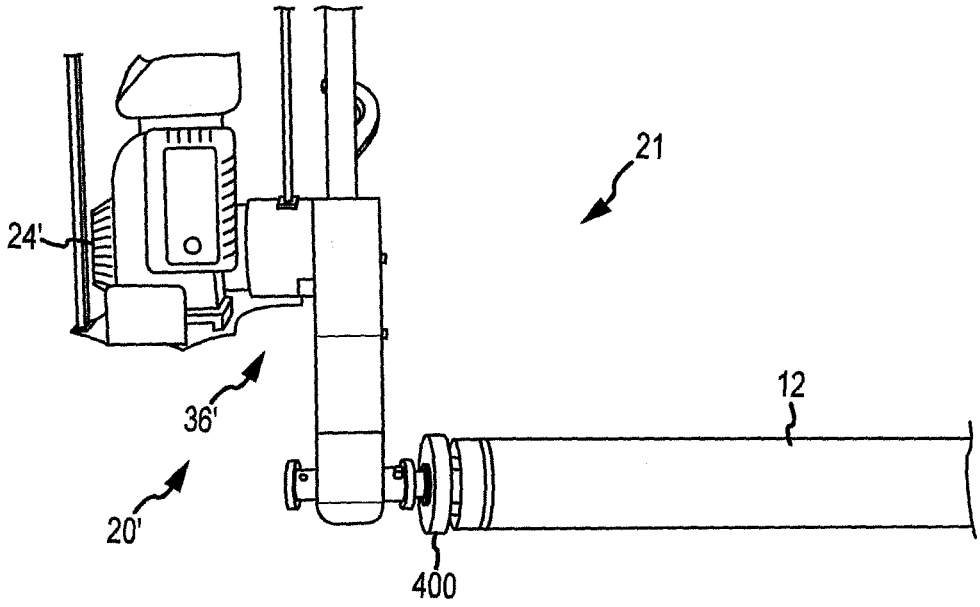
FIG. 11 is a perspective front view of a drive assembly end of the powered roller screed of FIG. 10.
Figure 12:
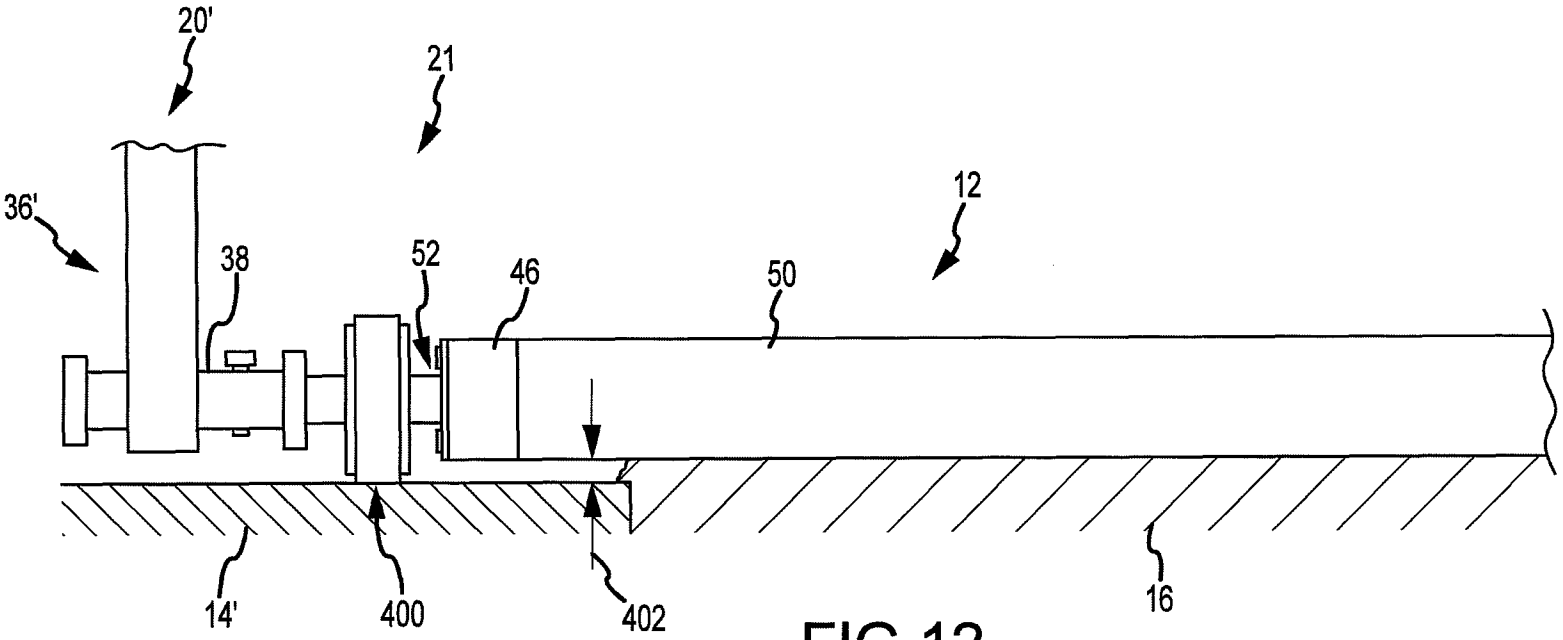
FIG. 12 is a front elevation view of the drive assembly end of the powered roller screed of FIG. 10, which includes a riser assembly, and illustrating a gap created by the riser assembly between a lower portion of the screed roller and a concrete slab on which the riser assembly is disposed.

Referring now to FIGS. 10 and 11, a drive assembly side 21 of the powered roller screed 10' again includes a riser assembly 400 that can elevate the screed roller 12 a distance above a concrete slab 14' during a screeding operation, and is freely rotatable relative to the screed roller 12. In this regard and as illustrated in FIG. 12, a gap 402 can be created between a portion of the screed roller 12 and the concrete slab 14'. Moreover, as the drive assembly 20' rotatably powers the screed roller 12, the riser assembly 400 is free to rotate and contact the concrete slab 14' as the operator(s) pull(s) on the handle assembly 26 and/or pull device 22 (e.g., the riser assembly 400 may roll along the concrete slab 14' at a speed dictated by the axial or linear speed that the screed roller 12 is being pulled, for instance the speed that its rotational axis is being displaced). The screed roller 12 can therefore be prevented from contacting or otherwise engaging the concrete slab 14', and can also level or finish the unfinished or poured concrete 16 at elevations above that of the concrete slab 14'.

Figure 13:
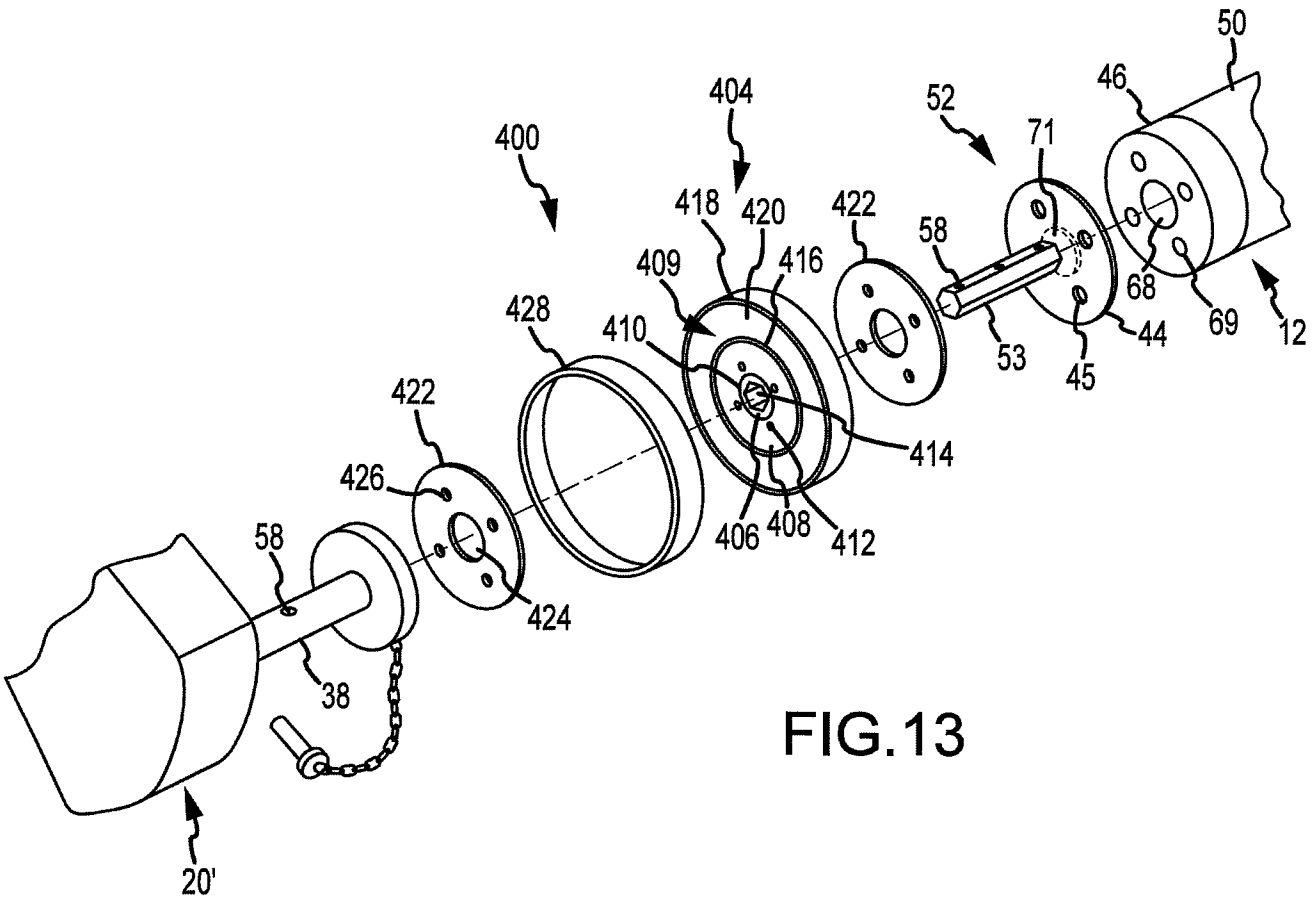
FIG. 13 is an exploded view of the drive assembly end of the powered roller screed of FIG. 10.
Figure 14:
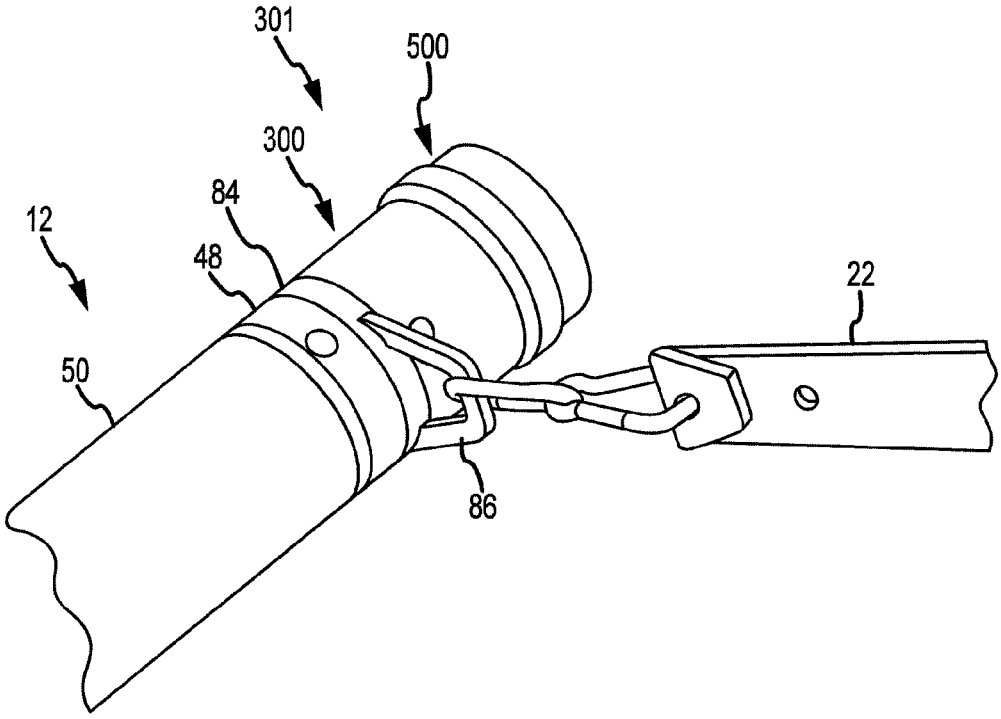
FIG. 14 is a perspective view of a non-powered or non-driven end of the powered roller screed of FIG. 10.

An exploded view of the drive assembly end 21 of the powered roller screed 10', along with the riser assembly 400, is illustrated in FIG. 13. The output of the drive motor 24' is configured so that it can be fitted to the drive socket 38, which can be of a common 6-point impact type as illustrated in FIG. 4 and discussed above. As the drive socket 38 passes through the motor frame 36', it again is encased by a socket bearing (not shown in FIGS. 12-13). The socket bearing again allows the drive socket 38 to spin with the drive motor 24', while securely holding it within the stationary motor frame 36'.

Interconnecting the screed roller 12 and the drive assembly 20' is a drive plate assembly 52. The drive plate assembly 52 may include a drive plate 44 and a shaft 53 extending generally perpendicularly from the drive plate 44. The drive plate 44 may have a circular shape or outer perimeter that is of the same outside diameter as the screed roller 12 and that allows for the attachment of the drive plate assembly 52 to the screed roller 12 through the use of a plurality of bolts or other suitable fasteners (not shown) being positioned through complementary shaped and sized apertures 45 in the drive plate 44 and apertures 69 in a female attachment plug 46. Additionally, the distal surface of the drive plate 44 can be equipped with a centrally located male shoulder 71 that can be introduced into a female recess 68 on the female attachment plug 46 to center the female attachment plug 46 of the screed roller 12 with reference to the drive plate assembly 52. This configuration not only transfers the rotational power of the drive motor 24' to the screed roller 12, but also ensures that all of the operational components are properly aligned.

The shaft 53 of the drive plate assembly 52 may have a hexagonal cross-section to engage the similarly shaped internal surface of the drive socket 38. Additionally, each of the shaft 53 and the drive socket 38 may include at least one attachment pin hole 58 that allows for fixed securement of the drive plate assembly 52 to the drive socket 38 of the drive assembly 20' (e.g., such that the shaft 53 will rotate along or collectively with the drive socket 38). In this regard, after the shaft 53 has been inserted into or otherwise engaged with the drive socket 38, an attachment pin or other fastener can be passed through an attachment pin hole 58 on each of the shaft 53 and the drive socket 38 to secure the two components together. Once the drive plate 44 has been appropriately secured to the screed roller 12 and the shaft 53 has been appropriately secured to the drive assembly 20', rotational power produced by the drive socket 38 can be directly transferred to the screed roller 12.

The riser assembly 400 may be disposed over a portion of the shaft 53 between the drive plate 44 and the drive socket 38. As will be described below, the riser assembly 400 includes a riser wheel 404 that elevates the screed roller 12 above the concrete slab 14' and that allows a portion of the riser assembly 400 to rotate independently of the drive assembly 20' and the screed roller 12. As such, a portion of the riser assembly 400 is adapted to rotate at a speed that depends upon the linear or axial speed that the operator(s) advance the powered roller screed 10'.

The riser wheel 404 broadly includes an inner plug 406, an inner ring 408, and a bearing assembly 409. The inner ring 408 may be in the form of a generally circular disc-shaped member having an axial bore 410 and a plurality of attachment apertures 412 disposed therethrough. The attachment apertures 412 allow washers 422 to be attached to the riser wheel 404 as will be later described.

The inner plug 406 of the riser wheel 404, which can also be in the form of a generally disc-shaped member, includes a central aperture 414, and can be press-fit or otherwise appropriately fixedly attached within the axial bore 410. The central aperture 414 of the inner plug 406 is sized and shaped to accept the shaft 53 of the drive plate assembly 52 and to prevent the shaft 53 from rotating with respect to the inner plug 406 and the inner ring 408 (i.e., such that the inner plug 406 and shaft 53 will collectively rotate). For instance, the central aperture 414 may be hexagonally shaped to accept the hexagonally shaped shaft 53. In other embodiments (not shown), the inner plug 406 may be removed and the axial bore 410 of the inner ring 408 may be formed to have a size and/or shape to non-rotatably accept the shaft 53 (i.e., such that the inner ring 408 and shaft 53 will collectively rotate).

The bearing assembly 409 includes an inner race 416, an outer race 418, a plurality of bearing members (not shown) situated between and within the inner and outer races 416, 418, and a pair of seal members 420 (only one being shown, but with one being on each side of the bearing assembly 408, where the two sides are spaced along the axis coinciding with the shaft 53) between the inner and outer races 416, 418. The seal members 420 serve to protect the bearing members by reducing the potential for the introduction of debris into the interior of the bearing assembly 409, and may be constructed of rubber, plastic, or any other suitable material. The inner and outer races 416, 418 can have complementary concave surfaces or other features that serve to contain the bearing members, and allow the bearing members to rotate or spin within the inner and outer races 416, 418. The bearing members thus allow the inner race 416 to rotate freely relative to the outer race 418, and as such may be in the form of balls, rollers, and the like. An outer portion of the inner ring 408 is appropriately secured to the inner race 416 by way of being press fit, the use of adhesives, or in any other appropriate manner. In this regard, the inner race 416 is fixedly and non-rotatably secured to both the inner ring 408 and the inner plug 406.

The riser assembly 400 may further include a pair of washers 422, each of which is secured to an outside or end surface of the riser wheel 404. Each washer 422 can be a plastic, disc-shaped member with a central bore 424 and a plurality of attachment holes 426. The attachment holes 426 are sized and spaced to substantially align with the attachment apertures 412 on the inner ring 408. Thus, after assembly of the riser wheel 404, the central bore 424 and attachment holes 426 of each washer 422 are respectively aligned over the central aperture 414 and attachment apertures 412 on one side of the riser wheel 404. Thereafter, fasteners (e.g., bolts, not shown) can be inserted through the attachment holes 426 and the attachment apertures 412 to secure the respective washer 422 to the side of the riser wheel 404. Each washer 422 serves to reduce the potential for the introduction of debris into the interior of the bearing assembly, in addition to reducing friction between the riser assembly 400 and the drive plate 44 and/or the drive assembly 20.

An outer ring 428 may be fixedly secured around the riser wheel 404. Outer ring 428 includes a central bore having a diameter that is equal to or just greater than an outer diameter of the riser wheel 404. As will be later described, if the riser wheel 404 does not provide a desired gap 402 for a screeding operation, one or more outer rings 428 can be secured about the outer race 420 of the riser wheel 404 by way of one or more set screws or other fasteners, a press-fit, adhesives, or the like. The outer ring 428 is therefore non-rotatably secured relative to the outer race 418 (e.g., the outer ring 428 and outer race 418 will collectively rotate) and serves to increase an outer diameter of the riser wheel 404 relative to an outer diameter of the screed roller 12.

There are a number of characterizations that may be made with regard to the riser wheel 404. One is that the rotational axes of the riser wheel 404 and the screed roller 12 may be coaxial. Another is that the riser wheel 404 may be a free-spinning structure. The riser wheel 404 may rotate relative to the screed roller 12. In one embodiment, the riser wheel 404 and the screed roller 12 rotate in opposite directions during a screeding operation (e.g., as the powered roller screed 10' is being pulled in the direction indicated by arrow A in FIG. 10).

With continued reference to FIGS. 10-13, one method of assembling the drive assembly end 21 of the powered roller screed 10' will now be described. It will be appreciated that other assembly methods may be possible. Initially, the inner plug 406 is inserted into the axial bore 410 of the inner ring 408, and the inner ring 408 is appropriately secured to or inserted within the inner race 416. Thereafter, if the outer diameter of the riser wheel 404 is either less than that of the screed roller 12 or else is not of a desired magnitude, an outer ring 428 of appropriate size can be press-fit or otherwise appropriately secured (e.g., via one or more fasteners, such as one or more set screws) to the outer race 418 of the riser wheel 404. Washers 422 can then be secured to the sides of the riser wheel 404 as described above. At this point, the riser assembly 400 has been assembled.

The drive plate 44 of the drive plate assembly 52 can be secured to the female attachment plug 46 of the screed roller 12. More specifically, the centrally-located male shoulder 71 on the drive plate 44 can be aligned with and inserted into the female recess 68 in the accessible end of the female attachment plug 46. Thereafter, bolts or other appropriate fasteners can be inserted through the complementary-shaped and sized apertures 45 on the drive plate 44 and apertures 69 on the female attachment plug 46 to fixedly secure the drive plate assembly 52 to the screed roller 12 (e.g., such that the drive plate assembly 52 and screed roller 12 may collectively rotate).

After the drive plate assembly 52 has been secured to the screed roller 12, the shaft 53 may be inserted through the central aperture 414 of the inner plug 406 of the riser wheel 404. As illustrated most clearly in FIG. 13, each of the shaft 53 and the central aperture 414 includes a hexagonal cross-section. Thus, once the shaft 53 has been inserted through the central aperture 414 and the riser assembly 400 is thus disposed on the shaft 53, the drive plate assembly 52 and the screed roller 12 become non-rotatably attached relative to the inner plug 406, inner ring 408 and inner race 416 (e.g., such that the shaft 53, inner plug 406, inner ring 408, and inner race 416 may collectively rotate). Finally, the shaft 53 is inserted into the drive socket 38 such that at least one attachment hole 58 on the drive socket 38 is aligned with at least one attachment hole 58 on the shaft 53. A fastener (e.g., bolt), pin, cotter key, or the like can then be inserted through the aligned attachment holes 58 to secure the drive plate assembly 52 and the screed roller 12 together such that each is inhibited from rotating or moving axially relative to the drive assembly 20' (e.g., such that the output of the drive assembly 20' may collectively rotate the drive plate assembly 52 and the screed roller 12).

At this point and as most clearly seen in FIGS. 10-12, the riser assembly 400 is situated on the shaft 53 between the drive socket 38 and the female attachment plug 46, and the screed roller 12 is elevated a distance above the screeded concrete 18 equal to the gap 402. While the shaft 53 is shown as being of a length that allows the riser assembly 400 to slide axially along the shaft 53 (while still being non-rotatable relative to the shaft 53) between the drive socket 38 and the female attachment plug 46, in other embodiments the shaft 53 is of a length and/or the riser assembly 400 is of a width that allows the riser assembly 400 to slide only minimally or else not at all between the drive socket 38 and the female attachment plug 46.

In operation, when the drive assembly 20' causes the drive socket 38 to rotate, the: a) drive plate assembly 52; b) inner plug 406, inner ring 408, inner race 416 and washers 422 of the riser wheel 400; and c) screed roller 12 will correspondingly rotate at an identical frequency. As such, the screed roller 12 can be rotatably powered to perform a screeding operation of the poured concrete 16. Conversely, the outer race 418 and any outer ring 428 of the riser assembly 400 (which is in contact with one of the concrete slabs 14') generally will not rotate or otherwise spin unless an operator or other force moves the entire powered roller screed 10' to a different location (e.g., during screeding). Even as the entire powered roller screed 10' moves to a different location while the drive assembly 20' is rotatably powering the screed roller 12, the outer race 418 and any outer ring 428 of the riser assembly 400 will only rotate as fast as the entire powered roller screed 10' moves between the locations. As such, screeding operations are facilitated for operators and the concrete slab 14' will not be marred or scratched because the operators do not encounter resistance from friction between the screed roller 12 and the concrete slab 14'. Moreover, operators can more easily finish and level the freshly poured concrete 16 at elevations above those of the concrete slab 14'.

With reference now to FIGS. 10 and 14-17, the non-powered end 301 of the powered roller screed 10' is presented that broadly includes a portion of the screed roller 12, the pull bearing assembly 84, a wall plug 300, and a riser assembly 500. Like the riser assembly 400, the riser assembly 500 can elevate the screed roller 12 a distance above the corresponding concrete slab 14' during a screeding operation and a gap (not labeled) can be created between: a) a portion of the screed roller 12 and wall plug 300; and b) the corresponding concrete slab 14' for reasons as previously described.

Figure 15:
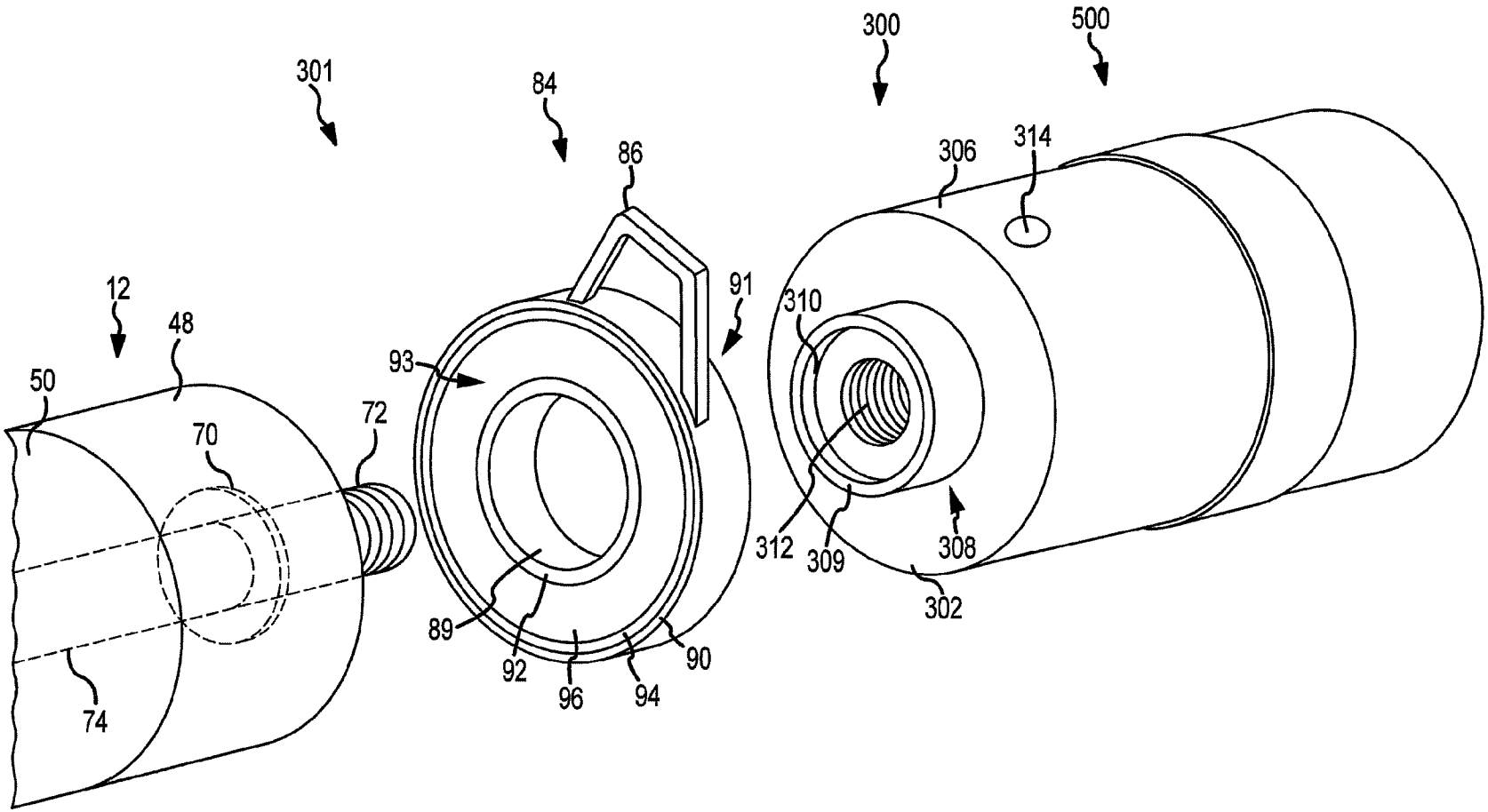
FIG. 15 is an enlarged, exploded, perspective view of the non-powered end of the powered roller screed of FIG. 10.
Figure 16:
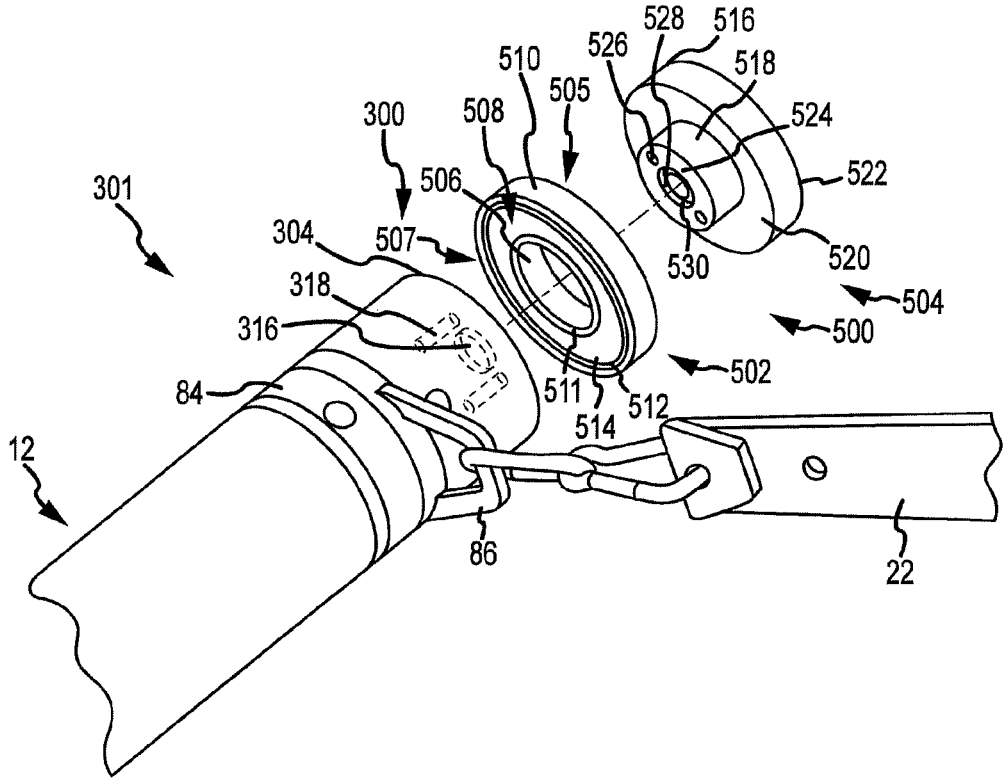
FIG. 16 is another exploded, perspective view of the non-powered end of the powered roller screed of FIG. 10.

Partial exploded views of the non-powered end 301 of the roller screed 10' are shown in FIGS. 15 and 16. The wall plug assembly 300 may be fixedly interconnected to the screed roller 12 and may sandwich the pull bearing assembly 84 along with the screed roller 12. In this regard, the wall plug assembly 300 can serve to position the pull bearing assembly 84 away from a distal end portion of the screed roller 12 and thus facilitate screeding operations for operators. The wall plug assembly 300 may generally include a cylindrical member having an outer diameter the same as that of the screed roller 12 and that rotates with the screed roller 12; as such, the wall plug assembly 300 is non-rotatable relative to the screed roller 12 in the same manner as the above-noted wall plug 164.

More specifically, the wall plug 300 may be in the form of a generally cylindrical extension member including first and second end walls 302, 304 and an outside or perimeter surface 306. A cylindrical hub 308 extends from the first end wall 302 and is adapted to be received in a central aperture 89 of the pull bearing assembly 84 as will be later described. The cylindrical hub 308 includes an outer surface 309 having an outer diameter that is generally of the same magnitude as the diameter of the central aperture 89 of the pull bearing assembly 84. In this regard and as will be later described, the cylindrical hub 308 can be disposed within the central aperture 89 of the pull bearing assembly 84 to fixedly and non-rotatably secure the wall plug 300 relative to an inner race 92 of the pull bearing assembly 84 (e.g., by providing a press-fit or interference fit between the wall plug 300 and the inner race 92 of the pull bearing assembly 84).

A female recess 310 may be situated within the cylindrical hub 308. The female recess 310 is sized and shaped to accept the correspondingly sized and shaped male shoulder 70 on the male attachment plug 48 of the screed roller 12. The female recess 310 and male shoulder 70 serve to center and align the wall plug 300 relative to the screed roller 12. Located within the female recess 310 is a threaded bore 312 that is sized and shaped to accept the threaded rod 72 extending from the screed roller 12 (more specifically from a male plug 48 on an end of the screed roller 12)). The wall plug 300 additionally includes a securement aperture 314 that intersects the threaded bore 312. Securement aperture 314 is adapted to receive a securement bolt or the like (not shown) to engage the surface of the threaded rod 72 and secure the threaded rod 72 within the wall plug 300.

With reference to FIG. 16, the second end wall 304 of the wall plug 300 may include a male shoulder 316 and a plurality of attachment apertures 318. The male shoulder 316 is sized and shaped to engage with a female recess 528 on an end plug 504, and the attachment apertures 318 are shaped to align with attachment bores 526 on the end plug 504 and accept fasteners as will be later described.

Referring back to FIG. 15, the pull bearing assembly 84 having first and second end surfaces 91, 93 is illustrated and is designed to provide an external surface on the screed roller 12 that is rotationally stationary when the bulk of the screed roller 12 and wall plug 300 are rotated during use. This is accomplished by the incorporation of an outer bearing body 90 that is rotationally isolated from the remaining components by a bearing assembly 88 (see FIG. 9). The outer bearing body 90 is equipped with a pull ring 86 that allows for the attachment of an external rotationally stationary device to the screed roller 12, such as pull device 22. Outer bearing body 90 may be press-fit or otherwise appropriately secured about an outer portion of the bearing assembly 88 as will be later described.

Bearing assembly 88 surrounds a central aperture 89 and can include an inner race 92, an outer race 94, a plurality of bearing members (not shown) situated between and within the inner and outer races 92, 94, and seal members 96 (only one being shown) between the inner and outer races 92, 94. The inner and outer races 92, 94 can have complementary concave surfaces or other features that serve to contain the bearing members therebetween and that allow the bearing members to rotate or spin within the inner and outer races 92, 94. The bearing members thus allow the inner race 92 to rotate freely relative to the outer race 94, and as such may be in the form of balls, rollers, and the like. The outer bearing body 90 may be fixedly secured by way of a press-fit, for instance about the outer race 94. In this regard and as seen back in FIG. 10, as an operator pulls on pull device 22, the outer bearing body 90 and outer race 94 remain stationary while the inner race 92, screed roller 12 and wall plug 300 can be rotated by the drive assembly 20'.

One method of connecting the screed roller 12, pull bearing assembly 84, and wall plug 300 will now be described, although other methods of connection are contemplated. Initially, the cylindrical hub 308 of the wall plug 300 is appropriately inserted or press-fit into the central aperture 89 from the first surface 91 to the second surface 93 of the pull bearing assembly 84 until the first surface 91 is in contact with the first end wall 302 of the wall plug 300 and the outer surface 309 of the cylindrical hub 308 has extended past the second surface 93. In one embodiment, the outer surface 309 of the cylindrical hub 308 can extend past the second surface 93 by a distance of about ⅛".

Thereafter, the male shoulder 70 on the male attachment plug 48 can be inserted into the female recess 310, and the threaded rod 72 can be inserted into and threaded to the threaded aperture 312 until the threaded rod 72 at least extends to/past the securement aperture 314. Finally, a securement bolt or the like can be threaded or otherwise inserted through the securement aperture 314 until it engages the threaded rod 72 to secure the threaded rod 72 within the wall plug 300. At this point, the wall plug 300 is fixedly and non-rotatably secured relative to the inner race 92 of the pull bearing assembly 84 and the screed roller 12, while the outer race 94 and the outer bearing body 90 are free to rotate independently of the wall plug 300, inner race 92, and screed roller 12. Moreover, because the outer surface 309 of the cylindrical hub 308 was mounted to extend past the second surface 93, in operation the pull bearing assembly 84 can slide axially along the cylindrical hub 308 by the distance that the cylindrical hub 308 extended past the second surface 93 during the connecting method. In this regard, the screed roller 12 and the wall plug 300 will not be prone to clamp or bind around the outer race 94 and outer bearing body 90 and thus inhibit their free rotation independent of the powered rotation of the screed roller 12, inner race 92 and wall plug 300.

The wall plug 300 positions the pull bearing assembly 84 and pull device 22 away from the end of the powered roller screed 10'. In this regard, an operator can screed freshly poured concrete right up to a wall or other vertical surface because the pull device 22 (and the operator's hands) are not directly adjacent to or abutting the wall or vertical surface. In an exemplary embodiment, the wall plug 300 can have a length of either 6 inches or 18 inches, but other wall plug 300 lengths are contemplated.

With continued reference to FIG. 16, the riser assembly 500 may broadly include a riser wheel 502 that serves to elevate a portion of the wall plug 300 and the screed roller 12 above a portion of the corresponding concrete slab 14', and an end plug 504 that mounts the riser wheel 502 to a portion of the wall plug 300.

The riser wheel 502 can have a central aperture 506, a bearing assembly 508 surrounding the central aperture 506, and an outer ring 510, and may further be defined by first and second outer surfaces 505, 507. Central aperture 506 is sized and shaped to accept connecting structures and fasteners associated with the wall plug 300 and the end plug 504 as will be later described. Similar to the bearing assembly 409, the bearing assembly 508 can include an inner race 511, an outer race 512, a plurality of bearing members (not shown) situated between and within the inner and outer races 510, 512, and a pair of seal members 514 (only one being shown) between the inner and outer races 510, 512. The inner and outer races 510, 512 can have complementary concave surfaces or other features that serve to contain the bearing members therebetween and that allow the bearing members to rotate or spin within the inner and outer races 510, 512. The bearing members thus allow the inner race 511 to rotate freely relative to the outer race 512, and as such may be in the form of balls, rollers, and the like.

The outer ring 510 may be fixedly secured about the outer race 512 of the riser wheel 502 to provide a desired elevation of the wall plug 300 and screed roller 12 above the corresponding concrete slab 14'. Outer ring 510 includes a central bore having a diameter that is equal to or just greater than an outer diameter of the outer race 512. As will be later described, one or more outer rings 510 can be fixedly secured about an outer portion of the outer race 512 to increase the diameter of the riser wheel 502 if the riser wheel 502 does not provide a desired elevation of the wall plug 300 and screed roller 12 above the concrete slab 14' for a screeding operation. The outer ring 510 can be secured by way of one or more set screws or other fasteners, a press-fit, adhesives, and the like.

Continuing to refer to FIG. 16, the end plug 504 serves to secure the riser wheel 502 to the wall plug 300 and as such sandwiches the riser wheel 502 between the wall plug 300 and the end plug 504. End plug 504 may include first and second discs 516, 518. First disc 516 generally includes first and second outer surfaces 520, 522 and an outer diameter. The outer diameter generally matches that of the wall plug 300 and the screed roller 12, and is generally larger than an outer diameter of the inner race 511 but smaller than an inner diameter of the outer race 512. Second disc 518 is fixedly secured to the first disc 516, and includes an outer surface 524 and an outer diameter smaller than that of the first disc 516. More specifically, the outer diameter of the second disc 518 may be generally of the same magnitude as the diameter of the central aperture 506 of the riser wheel 502. In this regard and as will be later described, the second disc 518 of the end plug 504 is adapted to be disposed within the central aperture 506 of the riser wheel 502 (e.g., to provide press-fit or interference fit between the end plug 504 and an interior portion of the riser wheel 502) to fixedly and non-rotatably secure the end plug 504 relative to the inner race 511, the wall plug 300, and the screed roller 12.

Figure 17:
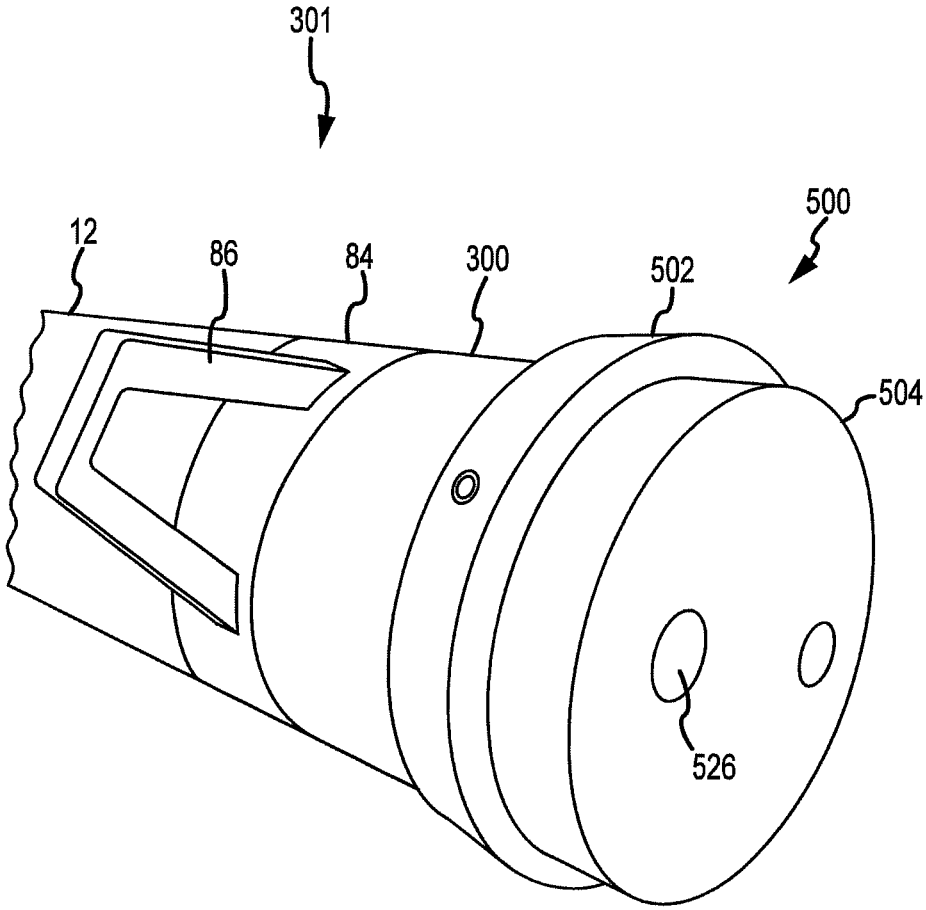
FIG. 17 is another perspective view of the assembled non-powered end of the powered roller screed of FIG. 10.

The outer surface 524 of the second disc 518 can include a plurality of attachment bores 526 and a female recess 528. Each attachment bore 526 extends from the outer surface 524 of the second disc 518 through the end plug 504 to the second outer surface 522 of the first disc 516 as shown in FIG. 17. As such, threaded fasteners (not shown) can be inserted through each attachment bore 516 from the second outer surface 522 of the first disc 516 and into the threaded attachment holes 318 on the wall plug 300 to fixedly and non-rotatably secure the end plug 504 relative to the wall plug 300. Female recess 528 is sized and shaped to accept the correspondingly sized and shaped male shoulder 316 on the wall plug 300. The female recess 528 and male shoulder 316 serve to center and align the end plug 504 relative to the wall plug 300. Female recess 528 additionally includes a central bore 530 that is sized to accept the threaded rod 72 that fixedly connects the screed roller 12 and the wall plug 300.

There are a number of characterizations that may be made with regard to the riser wheel 502. One is that the rotational axes of the riser wheel 502 and the screed roller 12 may be coaxial. Another is that the riser wheel 502 may be a free-spinning structure. The riser wheel 502 may rotate relative to the screed roller 12. In one embodiment, the riser wheel 502 and the screed roller 12 rotate in opposite directions during a screeding operation (e.g., as the powered roller screed 10' is being pulled in the direction indicated by arrow A in FIG. 10).

While one method of assembling the non-powered end 301 of the powered rotational screed apparatus 10 will now be described, other assembly methods may be possible. Initially, if the outer diameter of the riser wheel 502 is either less than that of the screed roller 12 and/or wall plug 300 or else is not of a desired magnitude, one or more outer rings 510 of appropriate size can be press-fit or otherwise appropriately secured to the outer race 512 of the riser wheel 502 (e.g., via one or more fasteners, such as one or more set screws). Thereafter, the second disc 518 of the end cap 504 can be appropriately inserted or press-fit into the central aperture 506 of the riser wheel 502 from the first outer surface 505 to the second outer surface 507 until the first outer surface 505 of the riser assembly 502 contacts the first outer surface 520 of the end plug 504 and the outer surface 524 of the second disc 518 has extended past the second outer surface 507 on the riser assembly 502. In one embodiment, the outer surface 524 of the second disc 518 can extend past the second outer surface 507 by a distance of about ⅛".

After the second disc 518 has been introduced into the central aperture 506, the male shoulder may be positioned within the female recess 528 to align the wall plug 300 and end plug 504. If necessary, either the wall plug 300 or end plug 504 can be rotated to align the attachment apertures 318 with the attachment bores 526. Fasteners (not shown) can then be inserted from the second outer surface 522 of the first disc 516 of the end plug 504 into the attachment apertures 318 on the wall plug 300 to fixedly and non-rotatably secure end plug 504 relative to the wall plug 300. Because the outer surface 524 of the second disc 518 was mounted to extend past the second outer surface 507 of the riser assembly 502, in operation the riser assembly 502 can slide axially along the second disc 518 by the distance that the second disc 518 extended past the second outer surface 507 during the connecting method. In this regard, the wall plug 300 and the end plug 504 will not be prone to clamp or bind around the outer race 512 and outer ring 510 and thus inhibit their free rotation independent of the powered rotation of the wall plug 300, inner race 511 and end plug 504.

Although one way of integrating a riser wheel with each end of the screed roller 12 has been described herein, any appropriate way of doing so may be utilized. When a riser wheel is associated with each end of the screed roller 12, the pair of riser wheels may have a common outer diameter or different outer diameters, depending upon the desired result. There also may be circumstances where only one of the riser wheels 404, 502 is utilized.

In operation and referring primarily to FIG. 10, rotational power generated by the drive assembly 20' can be directly transferred to screed roller 12, inner race 92 of pull bearing assembly 84, wall plug 300, inner race 511 of the riser wheel 502, and end plug 504 to perform a screeding operation of the poured concrete 16. Conversely, the outer race 94 and outer bearing body 90 of pull bearing assembly 84, and the outer race 512 and any outer ring 510 of the riser assembly 500 (as well as the outer race 418 and any outer ring 428 being utilized by the riser assembly 400), can rotate or spin independently of the above-described components. For instance and as seen in both FIGS. 10 and 14, as an operator pulls on the roller screed 10' using pull device 22, the outer bearing body 90 of the pull bearing assembly 84 remains stationary. Moreover, the outer race 512 and any outer ring 510 of the riser wheel 502 (as well as the outer race 418 and any outer ring 428 being utilized by the riser assembly 400) only rotate as fast as the operator pulls the entire roller screed 10. As such, screeding operations are facilitated for operators and concrete slabs 14' will not be marred or scratched because the operators do not encounter resistance from friction between the a) screed roller 12, wall plug 300 and/or end plug 504, and b) the concrete slab 14'. Moreover, operators can more easily finish and level the poured concrete 16 at elevations above those of the concrete slabs 14'.

In summary and as shown in FIGS. 10-12 and 14, the riser assemblies 400, 500 can be utilized in conjunction with the powered roller screed 10' to provide a gap 402 between the a) screed roller 12, wall plug 300, and end plug 504, and the b) concrete slabs 14'. In other embodiments, only one of the drive assembly end 21 or non-powered end 301 includes a riser assembly 400, 500. For instance, an operator may choose to utilize only one of the riser assemblies 400, 500 if only a single concrete slab 14' exists or if the operator wishes to impart a slope or incline to the poured concrete 16 once it cures. In further embodiments, one or more of the riser assemblies 400, 500 may be associated with the powered roller screed 10' at locations other than at the drive assembly end 21 or non-powered end 301. Other applications for the use of a single riser assembly 400, 500 may also exist.

The outer rings 428 and 510 of the riser assemblies 400 and 500 can be constructed of various outer diameters. In some embodiments, the outer diameter of the outer rings 428 and 510 can be ¼" greater than that of the screed roller 12 and wall plug 300, which correspondingly elevates the screed roller 12 and wall plug 300 ⅛" above the concrete slabs 14'. Such an elevation can facilitate a screeding operation for operators (e.g., contractors screeding a driveway) by decreasing the resistance experienced while pulling the powered roller screed 10' in addition to reducing wear on the concrete slab 14'. In other embodiments, the outer diameter of the outer rings 428 and 510 can be ¾" greater than that of the screed roller 12 and wall plug 300, which correspondingly elevates the screed roller 12 and wall plug 300 ⅜" above the concrete slabs 14'. Such an elevation is advantageous during the leveling of pervious poured concrete 16. It should be appreciated that the outer rings 428, 510 can have outer diameters of other sizes such as 1¼" and the like (to provide a ⅝" gap).

Additionally, while male shoulders and female recesses have been shown in particular locations in the embodiments, the male shoulders and female recesses can be reversed without departing from the scope of the embodiments. Moreover, the various components of pull bearing assemblies, riser wheels, wall plugs and end plugs with the exception of the sealing members can be generally composed of a high strength aluminum alloy, although the use of other materials for this purpose is possible. Aluminum may be used in this application due to its desirable strength to weight ratio.

Although the embodiments of the powered roller screed 10' have been described in considerable detail with reference to certain preferred versions thereof, other versions are possible. Therefore, the spirit and scope of the appended claims should not be limited to the description of the preferred versions contained herein.

The foregoing description of embodiments of the present invention has been presented for purposes of illustration and description. Furthermore, the description is not intended to limit the present invention to the forms disclosed herein. Consequently, variations and modifications commensurate with the above teachings, and skill and knowledge of the relevant art, are within the scope of the present invention. The embodiments described hereinabove are further intended to explain best modes known of practicing the present invention.

The embodiments described hereinabove are further intended to enable others skilled in the art to utilize the present invention in such or other embodiments and with various modifications required by the particular application(s) or use(s). It is intended that the appended claims be construed to include alternative embodiments to the extent permitted by the prior art.

What is claimed:

1. A concrete pour site comprising:

a concrete slab that is hardened;

poured concrete adjacent to said concrete slab; and a powered roller screed, wherein said powered roller screed comprises:

a screed roller comprising a first outer diameter;

a drive assembly comprising a motor, said drive assembly being interconnected with said screed roller and operable to rotatably power said screed roller;

first and second handles interconnected with said screed roller at first and second locations, respectively, that are spaced along a length dimension of said screed roller; and a first riser wheel interconnected with said screed roller, wherein said first riser wheel comprises a second outer diameter that is greater than said first outer diameter of said screed roller, wherein said first riser wheel and said screed roller are rotationally independent from each other, wherein said first riser wheel is positioned on said concrete slab, wherein a first end portion of said screed roller is spaced above said concrete slab, and wherein a second portion of said screed roller is engaged with said poured concrete.

2. The concrete pour site of claim 1, wherein said screed roller comprises a plurality of individual screed roller sections interconnected in end-to-end relation.

3. The concrete pour site of claim 1, wherein said first and second handles are associated with said first end portion and a second end portion respectively, of said screed roller.

4. The concrete pour site of claim 1, wherein said first riser wheel is positioned between a first end of said screed roller and said drive assembly.

5. The concrete pour site of claim 1, wherein said screed roller comprises first and second ends, wherein said drive assembly drives said first end, and wherein said second end is disposed between said first riser wheel and said first end.

6. The concrete pour site of claim 1, wherein said screed roller comprises first and second ends, wherein said drive assembly drives said first end, and wherein said second end is non-driven and is interconnected with said first riser wheel.

7. The concrete pour site of claim 1, further comprising:

a first bearing between said first riser wheel and said screed roller.

8. The concrete pour site of claim 1, wherein said first riser wheel is freely spinning.

9. The concrete pour site of claim 1, wherein said first riser wheel is rotatable relative to said screed roller.

10. The concrete pour site of claim 1, wherein said first riser wheel comprises an outer bearing race and an outer ring mounted on said outer bearing race, wherein said outer ring comprises said second outer diameter.

11. The concrete pour site of claim 1, further comprising:

a second riser wheel interconnected with said screed roller, wherein said second riser wheel comprises a third outer diameter that is greater than said first outer diameter of said screed roller, and wherein said second riser wheel and said screed roller are rotatably independent from each other.

12. The concrete pour site of claim 11, further comprising:

a bearing between said second riser wheel and said screed roller.

13. The concrete pour site of claim 11, wherein said second riser wheel is freely spinning.

14. The concrete pour site of claim 11, wherein said second riser wheel is rotatable relative to said screed roller.

15. The concrete pour site of claim 11, wherein said first riser wheel is positioned beyond a first end of said screed roller, and wherein said second riser wheel is positioned beyond a second end of said screed roller.

* * * * *